US010261431B2

(12) United States Patent
Jin et al.

(10) Patent No.: US 10,261,431 B2
(45) Date of Patent: Apr. 16, 2019

(54) EXTERNAL ADDITIVE FOR TONER, PROCESS FOR PRODUCING THE SAME, AND TONER COMPRISING THE SAME

(71) Applicant: Samsung Electronics Co., Ltd., Suwon-si (KR)

(72) Inventors: Hiromichi Jin, Yokohama (JP); Hiroshi Miyao, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/427,313

(22) Filed: Feb. 8, 2017

(65) Prior Publication Data

US 2017/0227862 A1 Aug. 10, 2017

(30) Foreign Application Priority Data

Feb. 9, 2016 (JP) ..... 2016-022515
Feb. 29, 2016 (JP) ..... 2016-036919
Feb. 8, 2017 (KR) ..... 10-2017-0017509

(51) Int. Cl.
*G03G 9/097* (2006.01)
*G03G 9/087* (2006.01)

(52) U.S. Cl.
CPC ..... *G03G 9/08773* (2013.01); *G03G 9/09725* (2013.01); *G03G 9/09733* (2013.01)

(58) Field of Classification Search
CPC ..... G03G 9/09725
See application file for complete search history.

(56) References Cited

U.S. PATENT DOCUMENTS 6,316,155 B1 11/2001 Kudo et al.
6,403,271 B1 6/2002 Suzuki et al.
6,479,206 B1 11/2002 Suzuki et al.
6,489,075 B2 12/2002 Suzuki et al.
6,653,035 B2 11/2003 Komoto et al.
8,431,633 B2 4/2013 Yoshikawa et al.
8,962,139 B2 2/2015 Zenitani et al.
9,052,622 B2 6/2015 Saito et al.
9,394,413 B2 7/2016 Yoshikawa et al.
2005/0203214 A1 9/2005 Amano et al.
2008/0070143 A1* 3/2008 Fomitchev ..... B82Y 30/00 430/108.24
2008/0268362 A1 10/2008 Kudo
2010/0143836 A1 6/2010 Miyamoto et al.
2012/0231381 A1 9/2012 Kitajima et al.
2015/0003875 A1* 1/2015 Ishigami ..... G03G 9/0821 399/223

FOREIGN PATENT DOCUMENTS

JP 6-27718 A 2/1994
JP 11-143118 A 5/1999
JP 2000-330328 A 11/2000
JP 2001-66820 A 3/2001
JP 2001-194824 A 7/2001
JP 2002-256173 A 9/2002
JP 2003-114544 A 4/2003
JP 2004-67475 A 3/2004
JP 2007-33696 A 2/2007
JP 2007-264142 A 10/2007
JP 2008-273757 A 11/2008
JP 2009-25809 A 2/2009
JP 2010-243664 A 10/2010
JP 2012-25596 A 2/2012
JP 2012-101953 A 5/2012
JP 2012-163623 A 8/2012
JP 2012-189960 A 10/2012
JP 2013-14489 A 1/2013
JP 2013-163622 A 8/2013
JP 2013-203650 A 10/2013
JP 2013-249215 A 12/2013
WO WO 2007/111349 A1 10/2007

* cited by examiner

*Primary Examiner* — Peter L Vajda
(74) *Attorney, Agent, or Firm* — NSIP Law

(57) ABSTRACT

An external additive for a toner includes: a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof. The particulate has the following properties: a number average particle diameter of about 50 nm to about 250 nm, a first specific surface area ($\alpha$) measured by a gas adsorption method of about 13 $m^2/g$ to about 80 $m^2/g$, and true density measured by a nominal volume expansion method of about 1.9 $g/cm^3$ to about 2.1 $g/cm^3$.

19 Claims, No Drawings

EXTERNAL ADDITIVE FOR TONER, PROCESS FOR PRODUCING THE SAME, AND TONER COMPRISING THE SAME

CROSS-REFERENCE TO RELATED APPLICATION

This application claims the benefit under 35 USC § 119(a) of Japanese Patent Application No. 2016-022515, filed on Feb. 9, 2016, in the Japan Patent Office, and Japanese Patent Application No. 2016-036919 filed on Feb. 29, 2016, in the Japan Patent Office, and Korean Patent Application No. 10-2017-0017509 filed on Feb. 8, 2017, in the Korean Patent Office, the entire disclosures of which are incorporated herein by reference for all purposes.

BACKGROUND

Field

This application relates to an external additive for a toner, a process for producing the same, and a toner including the same.

Description of the Related Art

Methods of visualizing image information via electrostatic images such as electrophotographic methods are currently used in various fields. Among them, the electrophotographic methods includes forming electrostatic images in a photoreceptor through a charge process and a photolithography process, developing electrostatic images by a developer including a toner, and then visualizing the developed electrostatic images through a transferring process and a fusion process. Developer used for the electrophotographic methods may include a two-component developer consisting of a toner and a carrier and a one-component developer using a magnetic toner or a non-magnetic toner alone. Two kinds of developers may include external additive for a toner so that it may be added to a surface of a toner particle and may improve fluidity and cleaning properties. The external additive for a toner is a particulate consisting an inorganic compound or an organic compound, and the binding force between a toner particle and an external additive for a toner includes an electrostatic attractive force (coulomb force) and a physical force (Van der Waals force), but is mainly controlled by the electrostatic attractive force. Recently, techniques of the electrophotographic methods are being developed in a direction toward higher speed, low energy consumption, so it is desirable for the toner to have a high degradation resistance. Unless the toner has high degradation resistance, it may be difficult to continuously maintain the high transfer efficiency of a toner during an image forming process. As one of the solutions for resolving such issues, technique using the spacer effects of a large particle diameter external additive has been suggested for suppressing the toner degradation. When a small particle diameter external additive and a large particle diameter external additive are used in a combination as the external additive, the small particle diameter external additive is less applied by direct external forces such as a shearing force or an impact force, by means of the large particle diameter external additive, and it may prevent the small particle diameter external additive from being buried in the surface of toner particle (spacer effect), so it may suppress the toner degradation. For materials of the large particle diameter external additive and the small particle diameter external additive, silica particles are generally used. However, when such a silica particle is used under severe environments of high temperature/high humidity or low temperature/low humidity, degradation of a toner and/or image defects may occur.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments provide an external additive for a toner having strong adhesion properties to a toner particle and having heat storage under a high temperature/high humidity environment, and simultaneously being capable of suppressing image defects caused by member contamination and even under a low temperature/low humidity environment for a long time, and being capable of suppressing image defects caused by member contamination, a process for producing the same, and a toner including the same.

In one general aspect, an external additive for a toner includes: a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof. The particulate has the following properties: a number average particle diameter of about 50 nm to about 250 nm, a first specific surface area (a) measured by a gas adsorption method of about 13 $m^2/g$ to about 80 $m^2/g$, and true density measured by a nominal volume expansion method of about 1.9 $g/cm^3$ to about 2.1 $g/cm^3$.

The particulate may further have the following properties: the number average particle diameter of about 60 nm to about 200 nm, the first specific surface area (a) of about 15 $m^2/g$ to about 40 $m^2/g$, and a total light transmittance of a film formed of the particulate and having a thickness 100 μm is greater than or equal to about 80% and the film a haze of less than or equal to about 10%.

A presence ratio of the particulate may be less than or equal to average about 3%, the presence ration being defined as an area of a circumscribed circle relative to the visual area of the particulate under a scanning electron microscope of a ×10000 magnification and visual area of 110 $\mu m^2$, is defined as a presence ratio of a coarse particulate, the The particulate may have a ratio ($\alpha/\beta$) of the first specific surface area (a) relative to a second specific surface area ($\beta$) calculated from a number average particle diameter of about 0.4 to about 1.75.

A surface hydrophobization degree of the particulate may be about 30 volume % to about 80 volume %.

When the particulate is dispersed in a solution, a value obtained by dividing a specific gravity distribution of the particulate dispersed in the solution by the true density measured by a nominal volume expansion method is referred to as a specific weight distribution, and about 95% to about 100% of the specific weight distribution is referred to as a first specific weight region, about 90% to about 95% of the specific weight distribution is referred to as a second specific weight region is referred to as a second specific weight, the external additive for a toner may further include the first specific weight region including about 0.5 wt % to about 9 wt % of the particulate, and the second specific weight region including about 0.5 wt % to about 6 wt % of the particulate based on a total amount of the particulate dispersed in the solution.

A loss on heating of the particulate may be about 3 wt % to about 10 wt %.

In another general aspect, a process for producing an external additive for a toner includes performing, at least once, processes of dissolving at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof in an organic solvent to obtain a silicon compound solution, mixing the silicon compound solution and a catalyst-containing component including a basic compound with a solution including water to obtain a mixed solution; and adding at least one of the silicon compound and the catalyst-containing component to the mixed solution and mixing them to obtain particulate dispersion liquid.

The process for producing the external additive for a toner may further include adding the catalyst-containing component after adding the silicon compound when the silicon compound and the catalyst-containing component are added during obtaining of the particulate dispersion liquid.

In the process for producing an external additive for a toner, when a weight of the organic solvent is referred to as $W_o$ during obtaining of the silicon compound solution and a maximum weight of the silicon compound that added once is referred to as $W_s$ during obtaining of the silicon compound solution and obtaining of the particulate dispersion liquid, $W_s/W_o$ may be less than or equal to about 0.15.

The process may further include removing the catalyst-containing component from the particulate dispersion liquid.

The removing of the catalyst-containing component may be performed at a removal temperature (T1) of about 60° C. to about 100° C. and a removal time (t1) of less than or equal to about 8 hours.

The process may further include hydrophobizing a surface of the particulate obtained from removing of the catalyst-containing component to obtain a first hydrophobized particulate.

The obtaining of the first hydrophobized particulate may be performed at a treatment temperature (T2) of about 80° C. to about 150° C. and a treatment time (t2) of less than or equal to about 12 hours.

The removal temperature (T1), the removal time (t1), the treatment temperature (T2) and the treatment time (t2) may satisfy a relationship of $4805\ (T1\times t1)+(T2\times t2)\leq 2600$.

The process may further include hydrophobizing a surface of the first hydrophobized particulate using at least one compound selected from a silazane compound represented by Chemical Formula 2: $R^2{}_3SiNHSiR^2{}_3$ (wherein $R^2$ is a C1 to C6 monovalent hydrocarbon group) and a silane compound represented by Chemical Formula 3: $R^3{}_3SiX$ (wherein $R^3$ is a C1 to C6 monovalent hydrocarbon group and X is a hydroxy group or a hydrolytic group) as a hydrophobization agent to obtain a second hydrophobized particulate.

In another general aspect, an external additive for a toner is prepared by the process for producing an external additive for a toner.

In yet another general aspect, a toner includes the external additive for a toner.

Other features and aspects will be apparent from the following detailed description and the claims.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent alter an understanding of the disclosure of this application.

As used herein, the singular forms are intended to include the plural forms as well, unless the context clearly indicates otherwise. The terms "comprise," "include," and "have," when used in this application, specify the presence of stated features, numbers, operations, elements, components, or combinations thereof, but do not preclude the presence or addition of one or more other features, numbers, operations, elements, components, or combinations thereof.

As used herein, the term "about" means that the numerical value is approximate and small variations would not significantly affect the practice of the disclosed embodiments. Where a numerical limitation is used, unless indicated otherwise by the context, "about" means the numerical value can vary by ±10% and remain within the scope of the disclosed embodiments.

Unless otherwise defined herein, all terms used herein, including technical or scientific terms, have the same meanings as those generally understood by one of ordinary skill in the art to which the disclosure of this application pertains. Terms defined in general-use dictionaries are to be interpreted as having meanings that are consistent with their meanings in the relevant art, and are not to be interpreted in an idealized or overly formal sense unless expressly so defined herein.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

As used herein, the term "resin" has substantially the same meaning as the term "polymer," and thus these terms are interchangeable.

External Additive for Toner

An external additive for a toner according to an embodiment includes a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product.

A raw material for forming the particulate may include a tetrafunctional silane compound represented by Chemical Formula 1 or a hydrolysis-condensation product of the silane compound.

The tetrafunctional silane compound as a monomer may be a silane compound, for example tetramethoxysilane (TMOS), tetraethoxysilane (TEOS), tetrapropoxysilane, tetrabutoxysilane, and other silanes, but embodiments are not limited thereto.

The hydrolysis-condensation product of the tetrafunctional silane compound is a hydrolysis-condensation product obtained by a condensation reaction of a functional group having hydrolytic properties such as a methoxy group or an ethoxy group of the tetrafunctional silane compound, and may be a dimer or an oligomer, but an example embodiment is not limited thereto.

Through a condensation polymerization reaction of the tetrafunctional silane compound, the hydrolysis-condensation product of the tetrafunctional silane compound, or a combination thereof, a part of alkoxy groups ($O—R^1$) of Chemical Formula 1 becomes hydroxy groups (—OH), and water ($H_2O$) is left by a condensation polymerization between the hydroxy groups (—OH) based regions to provide a silicone compound particulate formed with a siloxane group (Si—O—Si) which is converted from silanol group (Si—OH).

As the obtained particulate has a structure in which a plurality of siloxane groups (Si—O—Si) is formed, it may satisfy a strength required for the external additive for a toner.

Meanwhile, a residual hydroxyl group (—OH) may be present on the surface of the particulate after the condensation polymerization. The residual hydroxyl group (—OH) on the surface of the particulate may be bonded with the hydrophobic groups described later and hydrophobized.

Hereinafter, various properties of the particulate and measuring methods thereof are described in detail.

Property (1): Average Particle Diameter

Property (1) of the particulate according to an embodiment is an average particle diameter and the average particle diameter refers to a number average particle diameter of the particulate.

The average particle diameter range of the particulate according to an embodiment may impart adhesion properties to suppress degradation of a toner to the particulate and may have a level to exhibit the spacer effect.

The number average particle diameter according to an embodiment may be, for example greater than or equal to about 50 nm, greater than or equal to about 60 nm, greater than or equal to about 70 nm, or greater than or equal to about 80 nm and for example less than or equal to about 250 nm, less than or equal to about 230 nm, less than or equal to about 200 nm, or less than or equal to about 150 nm.

When the particulate has an average Particle diameter of less than about 50 nm, a size difference of a large particle diameter external additive having a relatively large particle diameter and a small particle diameter external additive having a relatively small particle diameter becomes less, so that it is difficult to provide the spacer effect by the large particle diameter external additive sufficiently. When the particulate has an average particle diameter of greater than about 250 nm, a quantity of electric charges is decreased, an adhesion force between the particulate and the toner particle may be deteriorated, a deviation between the large particle diameter external additive and the small particle diameter external additive becomes excessively larger, so that it is difficult to provide the spacer effect.

The average particle diameter according to an embodiment may be obtained through a particle distribution of the particulate measured by dynamic light scattering.

Dynamic light scattering is a method of measuring a particle diameter by irradiating laser light to a particulate and converting how a scattering intensity of scattering light is changed by the particle diameter of the particulate.

The average particle diameter of Property (1) may be obtained by a particle distribution of a silica particulate measured by dynamic light scattering.

Particle distribution is measured using dynamic light scattering by irradiating laser light to a silica particulate and using a change of scattering light depending on a time by Brownian motion of a silica particulate. A speed of Brownian motion of the particulate is dependent on a size of the particle.

A particle distribution measuring device of the particulate by dynamic light scattering may be, for example a device for measuring a dynamic light scattering particle distribution (e.g., ELSZ1000ZS, Otsuka Electronics). When using the measuring device, a particle distribution of the particulate is measured as follows, and then an average particle diameter of the particulate may be calculated.

A predetermined amount of an external additive for toner including the particulate is mixed with an organic solvent such as, for example, methanol, and then applied with ultrasonic wave to provide a liquid dispersion in which the particulate is dispersed. The liquid dispersion is input into a measuring cell made of, e.g., glass and then introduced into a device for measuring a dynamic light scattering particle distribution (e.g., ELSZ1000ZS, manufactured by Otsuka Electronics).

The measuring cell is then irradiated by laser light and a dynamic light scattering intensity of dispersion solution is measured.

When the particle diameter distribution calculated from the measured dynamic light scattering intensity is illustrated in a second-dimension coordinate having a vertical axis of the particle diameter distribution and a cross axis of a number frequency, the average particle diameter is defined as the particulate diameter in which the number of the particulate included in the particle diameter range divided based on the particle diameter distribution is reached to accumulation 50% when accumulated from small diameter.

On the other hand, the average particle diameter may be obtained by other methods such as a laser diffraction/scattering method or an image analysis method in addition to the dynamic light scattering method. However, even if the average particle diameter of the particulate is different from the value ranges measured by the other measuring methods, it belongs to Property (1) according to an embodiment as long as the results measured by a method of measuring a particulate average particle diameter according to the embodiment belongs to Property (1) ranges according to an embodiment.

Property (2): First Specific Surface Area ($\alpha$)

Property (2) of the particulate according to an embodiment is a first specific surface area ($\alpha$). The first specific surface area ($\alpha$) refers to a specific surface area of the particulate measured by the gas adsorption method. The first specific surface area ($\alpha$) shows a surface structure and a particle diameter, being capable of suppressing degradation of the toner and simultaneously improving the adhesion to the toner when attaching the particulates on the toner particle and being capable of imparting the spacer effect when the external additive including the particulate is used with a large particle diameter external additive.

In an embodiment, the first specific surface area ($\alpha$) of the particulate may be, for example greater than or equal to about 13 $m^2/g$, greater than or equal to about 15 $m^2/g$, greater than or equal to about 20 $m^2/g$, and for example less than or equal to about 80 $m^2/g$, for example less than or equal to about 75 $m^2/g$, less than or equal to about 60 $m^2/g$, less than or equal to about 50 $m^2/g$, or less than or equal to about 40 $m^2/g$.

When the first specific surface area ($\alpha$) is less than about 13.0 $m^2/g$, the particulate may have an excessively large diameter, a quantity of electric charge may be decreased, and thus adhesion forces between toner particles may be reduced, and the particulate having spacer effects are left and thereby storage-stability of the toner may be deteriorated and simultaneously contaminations of photoreceptors, electrified rolls, or development rolls or cleaning blade defects may occur.

While when the specific surface area is greater than about 80 $m^2/g$, large fine concavo-convex parts on the surface of the silica particulate may be generated, a strength of the silica particulate may be deteriorated, and simultaneously damages or contaminations of members by the external additive may occur.

The gas adsorption method for measuring the first specific surface area ($\alpha$) according to an embodiment is, for example, a method including: inputting a particulate into a measuring cell, spraying an adsorptive gas on the surface of the particulate to contact each other while monitoring a relative pressure change of the adsorptive gas, cooling the same to liquid nitrogen temperature (between about 63K and about 77 K) to adsorb the adsorptive gas on the particulate surface, and then returning to room temperature to exhaust the adsorptive gas adsorbed on the particulate surface.

When the relative pressure of the adsorptive gas is lower than an initial value, a gas adsorption process is performed, and the gas adsorption time refers to a time when the relative pressure is beginning to become lower than the initial value of the adsorptive gas until it is returned to the initial value.

When the relative pressure of the adsorptive gas is higher than the initial value, a gas desorption process is preformed, and a gas desorption time refers to a time when the relative pressure is beginning to become lower than the initial value of the adsorptive gas until it is returned to the initial value.

The gas adsorption method uses a phenomenon that the adsorptive gas is adsorbed on a monomolecular layer of the particulate surface on the cooling, and it may provide a gas adsorption time or a gas desorption time by reflecting a surface structure or a size of the particulate. That is, the gas adsorption time and the gas desorption time are each proportional to the specific surface area of the particulate.

For example, when the first specific surface area ($\alpha$) of the particulate is obtained through the gas adsorption time, it may obtain U-shaped curve expressing a gas adsorption step in which the relative pressure is decreased less than the initial value and $\cap$-shaped curve expressing a gas desorption step in which the relative pressure is increased more than the initial value, in a 2-dimensional coordinate with a vertical axis of the relative pressure of a nitrogen gas and a cross axis of a time. In the predetermined two-dimensional coordinate, the first specific surface area ($\alpha$) of the particulate may be obtained by calculating an area between the cross axis of a time axis and U-shape curved line expressing a gas absorption step.

The adsorptive gas may include gas having molecules capable of adsorbing on a monomolecular layer of the particulate surface, for example, at the liquid nitrogen temperature by the van der Waals force between the particulates and gas molecules, and may be, for example, krypton gas, argon gas, carbonate gas, or a combination thereof.

The gas adsorption method may be referred to as a BET (Brunauer-Emmett-Teller) method.

In an embodiment, for example nitrogen gas may be used as the adsorptive gas and a measuring device to obtain the first specific surface area ($\alpha$) by a BET method may be, for example, a BET flow measuring device of a specific surface area (MODEL HM1201, manufactured by Mountech).

When using the measuring device, for example as a measuring cell comprising a U-shaped object including a gas inlet, and a gas outlet may be used and a gas injected into the measuring cell may be, for example, a mixed gas of a nitrogen gas (adsorptive gas) and a helium gas (carrier gas).

The first specific surface area ($\alpha$) may be obtained by using a different measuring method and/or device in addition to the measuring method and/or the device. However, even if the first specific surface area ($\alpha$) of the particulate is different from the value ranges measured by the other measuring methods, it belongs to Property (2) according to an embodiment as long as the results measured by a method of measuring a first specific surface area ($\alpha$) of the particulate according to the embodiment belongs to Property (2) ranges according to an embodiment.

Property (3): True Density

Property (3) of the particulate according to an embodiment is a true density, and the true density is an average specific gravity calculated from the measured volume and mass of the particulate and may be measured by a nominal volume expansion method. The true density of the particulate according to an embodiment may have a lower value than a general true density (2.2 $g/m^3$) of a conventional silica particulate external additive.

Since the particulate according to an embodiment is lighter than a conventional silica particulate external additive having the same size, an impact force to the toner particle may be lowered when being externally added to the toner, and degradation of the toner may be suppressed.

The true density of the particulate according to an embodiment may be, for example, about 1.9 $g/cm^3$ to about 2.1 $g/cm^3$.

Property (3) of the particulate according to an embodiment may be expressed as a true specific gravity. The true specific gravity refers to a weight ratio of the measured mass of the particulate and a weight of water having the same volume as a volume of the particulate measured by a nominal volume expansion method, and the true density and the true specific gravity may be measured by the same method. The true specific gravity of the particulate according to an embodiment has a corresponding value to the true density. That is, the true specific gravity according to Property (3) may be, for example, about 1.9 to about 2.1. In an embodiment, Property (3) may be, for convenience, referred to as a true density except that the particulate is dispersed in the solution like Property (8) that will be described later.

When the true density is less than about 1.9 $g/cm^3$ (or the true specific gravity is less than about 1.9), the particulate has excessively light weight, and an impact force to the toner particle when being externally added is decreased and a strength of the particulate itself may be deteriorated. When the true density is greater than about 2.1 $g/cm^3$ (or the true specific gravity is greater than 2.1), the particulate has excessively heavy weight and an impact force to the toner particle when being externally added is increased.

A device for measuring the true density according to an embodiment may be, for example a dry-auto density measurer (Aqupic II Series 1340, manufactured by Shimadzu).

When using the device, a predetermined silica particulate is put into a density measurer and the true density may be automatically measured.

The true density may be obtained by using a different measuring method and/or device in addition to the measuring method and/or the device. However, even if the true density of the particulate is different from the value ranges measured by the other measuring methods, it belongs to Property (3) according to an embodiment as long as the results measured by a method of measuring a true density of the particulate according to an embodiment, result belongs to Property (3) ranges according to an embodiment.

Property (4): Total Light Transmittance and Haze when Particulate is Formed into Film Property (4) of the particulate according to an embodiment is total light transmittance and haze when the particulate is formed into a film. As referred to herein, the term "total light transmittance" refers to total light transmittance. "The total light" means the light comprising visible light, infrared light, and ultraviolet light.

The haze refers to a ratio of scattering transmittance in the total light transmittance and expresses a microscopic optical scattering degree by the particulate.

More specifically, when the particulate according to an embodiment is formed into a film having a thickness of 100 μm, the total light transmittance of the film may be greater than or equal to about 80% and the haze of the film may be less than or equal to about 10%.

On the other hand, when a silica particulate is formed into a film having a thickness of 90 μm, the total light transmittance of the film may be greater than or equal to about 81% and the haze of the film may be less than or equal to about 9%.

On the other hand, when a silica particulate is formed into a film having a thickness of 110 μm, the total light transmittance of the film may be greater than or equal to about 78% and the haze of the film may be less than or equal to about 12%.

In general, a coarsened particulate may be left from the toner surface and toner storage properties may be degraded. However, when the particulate is formed into a film as described above, a presence ratio of the coarsened particulate may be quantitatively controlled under a certain level as long as the total light transmittance and the haze satisfy the range. Therefore, when the particulate according to an embodiment is used as an external additive for a toner under severe environments of a low temperature/low humidity or a high temperature/high humidity, a toner having improved storage properties and printing quality may be obtained.

A diameter of the coarse particulate is greater than or equal to about 1 μm which is greater than a wavelength (about 0.38 μm to about 0.78 μm) of visible light and an amount of the coarse silica particulate affects total light transmittance or haze.

Because an average particle diameter (a number average particle diameter) of the particulate defined as Property (1) is less than or equal to about 0.25 μm and is smaller than a wavelength of visible light, an effect on the total light transmittance or haze is relatively slight. Therefore, a presence ratio of the coarse silica particulate may be easily controlled under a predetermined level through Property (4).

In measurement of the total light transmittance or haze, when liquid including the dispersed particulate as a measurement subject, a particulate having a heavy specific gravity is sedimented and thus measurement precision may be decreased. On the contrary, when a film formed of the particulate as a measurement subject, there are no sedimentation problems and thus measurement precision of Property (4) may be improved.

The film may be formed, for example, by mixing a silica powder with liquid such as methylisobutylketone and other solvents to form silica dispersion liquid, coating the resultant using an applicator, and drying the same.

However, an embodiment is not limited to the producing process and for example, the coating may be performed using a dip coating, spin coating, or inkjet coating method.

A thickness of the film may be controlled using a probe film thickness measurer, an optical film thickness measurer, and other thickness measuring apparatuses.

The total light transmittance and the haze of the film may be measured using a haze meter (NDH-5000W, Suga Test Instrument Co., Ltd.).

The total light transmittance and the haze of the film may be obtained by using a different measuring method and/or device in addition to the measuring method and/or the device. However, even if the total light transmittance and the haze of a film consisting of the particulate is different from the value ranges measured by the other measuring methods, they belong to Property (4) according to an embodiment as long as the results measured by a method of measuring the total light transmittance and haze of a film consisting of the particulate according to an embodiment belong to Property (4) ranges according to an embodiment.

Property (5): Presence Ratio of Coarse Particulate

Property (5) of the particulate according to an embodiment is a presence ratio of the coarse particulate. The particulate having Properties (1) to (4) may satisfy Property (5).

In an embodiment, the presence ratio of the coarse particulate refers to an area of a circumscribed circle relative to the visual area of the particulate under a scanning electron microscope of a ×10000 magnification and visual area of 110 $\mu m^2$ condition.

More specifically, when the particulate according to an embodiment is examined ten times with the visual area under a scanning electron microscope of a ×10000 magnification and visual area of 110 $\mu m^2$ condition, a presence ratio of the coarse particulate may be less than or equal to average about 3%.

When the particulate having Property (5) is used as an external additive for a toner, a toner having improved storage properties and printing quality may be obtained under severe environments of a low temperature/low humidity or a high temperature/high humidity.

A coarse particulate that is abnormally generated by a sol-gel method is an agglomerate where most of the particulates are agglomerated. The coarse particulate is an agglomerate having a specific shape, but a circumscribed circle is set for the agglomerate and a diameter of the circumscribed circle is defined as a particle diameter of the coarse particulate.

In addition, by measuring a ratio of an area of the agglomerate having a particle diameter of greater than or equal to about 1 μm relative to an examined visual area, a presence ratio of the coarse particulate is obtained.

When the presence ratio of the coarse particulate is greater than or equal to about 3%, an external additive may be easily detached from a toner and thus storage-stability of a toner may be deteriorated. In addition, the coarse particulate is an amorphous agglomerate that is liable to have a concavo-convex, defects of a cleaning blade or a photoreceptor may be caused and filming may be generated.

Property (6): Ratio (α/β) of First Specific Surface Area Relative to Second Specific Surface Area Property (6) of the particulate according to an embodiment refers to a ratio (α/β) of the first specific surface area (α) relative to the second specific surface area (β).

The particulate having Properties (1) to (4) or Properties (1) to (5) may satisfy Property (6).

In an embodiment, the second specific surface area (β) (unit: $m^2/g$) may be calculated from Equation 1.

$$\beta=\{6/(D_n50\times p)\}\times 1000 \quad \text{[Equation 1]}$$

In Equation 1, $D_n50$ denotes a number average particle diameter (unit: nm) of the particulate and p denotes a true density (unit: $g/cm^3$).

The ratio (α/β) of the first specific surface area (α) relative to the second specific surface area (β) of the particulate according to an embodiment may be, for example greater than or equal to about 0.4, greater than or equal to about 0.5, greater than or equal to about 0.6, greater than or equal to about 0.7, greater than or equal to about 0.8, or greater than or equal to about 0.85, and for example less than or equal to about 1.75, less than or equal to about 1.5, less than or equal to about 1.4, less than or equal to about 1.3, less than or equal to about 1.2, less than or equal to about 1.1, less than or equal to about 1.0, less than or equal to about 0.9, or less than or equal to about 0.8.

When the ratio (α/β) of the first specific surface area (α) relative to the second specific surface area (β) is less than about 0.4, the particulate has excessively small particle diameter, so that it is difficult to impart the spacer effect when the external additive including the particulate is used as the external additive having a large particle diameter; while when the ratio (α/β) of the first specific surface area (α) relative to the second specific surface area (β) is greater than about 1.7, the protruded portions shapely protruded from the particulate surface are increased, so that a ratio of abnormally concentrating charge is increased, and particulate is strongly attached to the photoreceptor or other materials by the concentrated charge to cause the contamination of photoreceptors, electrified rolls, development rolls, and other components.

Meanwhile, the particulate having the ratio (α/β) of the first specific surface area (α) relative to the second specific surface area (β) within the range also satisfies Property (3) of the true density, so it may maintain the required strength as the external additive for toner even if it is relatively light weight.

Property (7): Hydrophobization Degree

Property (7) of the particulate according to an embodiment is a hydrophobization degree of the particulate.

The hydrophobization degree refers to a ratio of hydrophobic groups formed on the surface of the particulate relative to the entire particulate surface, and hydrophobic group may provide hydrophobicity on the surface of the particulate and reduce the hygroscopicity of the particulate, so that a quantity of electric charge of the external additive and the toner may be maintained in an appropriate level.

The particulate satisfying Properties (1) to (4) or satisfying at least one of Property (5) and Property (6) may satisfy Property (7).

On the other hand, according to one embodiment, the method of measuring a hydrophobization degree includes a methanol titration. More specifically, a predetermined amount of ion exchange water and a particulate powder are put into a beaker and dripped with methanol from a burette while a dispersion of the hydrophobic particulate powder is stirred by a magnetic stirrer.

As the methanol concentration in the beaker increases, the particulate powder is slowly sedimented, and a volume fraction of methanol in the methanol-water mixed solution when a total amount of the particulate powder is sedimented is defined as a hydrophobization degree (volume %) of hydrophobic particulate powder.

In an embodiment, the hydrophobization degree of the particulate may be, for example, greater than or equal to about 30 volume %, greater than or equal to about 40 volume %, greater than or equal to about 50 volume % and less than or equal to about 90 volume % or less than or equal to about 80 volume %.

When the hydrophobization degree satisfies the ranges, the particulate and the toner including the externally added particulate may have a quantity of electric charge in an appropriate level.

When the hydrophobization degree is less than about 30 volume %, the hygroscopicity of the particulate is increased and thus electrification of the external additive and the toner may be deteriorated, while when the hydrophobization degree is greater than about 80 volume %, a quantity of electric charge of the particulate may be excessively increased and thus charges may move into another places and image degradation may be caused.

Property (8): Specific Weight Region

Property (8) of the particulate according to an embodiment is a specific weight region of the particulate.

More specifically, the particulate according to an embodiment is dispersed in a solution having a predetermined specific gravity and a specific gravity distribution of the particulate dispersed in the solution is obtained. In addition, a value obtained by dividing the calculated specific gravity distribution by the true density (more specifically true specific gravity) according to Property (3) is defined as a specific weight distribution.

Herein, when 95% to 100% of the specific weight distribution is defined as a first specific weight region and about 90% to about 95% of the specific weight distribution is defined as a second specific weight region is referred to as a second specific weight, the first specific weight region includes about 0.5 wt % to about 9 wt % of the particulate and the second specific weight region includes about 0.5 wt % to about 6 wt % of the particulate based on a total amount of the particulate dispersed in the solution.

The ranges of the specific weight distribution and the first and second specific weight regions are obtained by experiments and a silica particulate according to an embodiment is distributed within the ranges in the first and second specific weight regions and thus has an appropriate strength to be used as an external additive and an impact force to a toner particle when being externally added and a distribution of a quantity of electric charge may be minimized.

Accordingly, when the particulate satisfying Property (8) is used as an external additive, damages of a toner particle may be minimize while maintaining good durability or fluidity and degradation or member contamination may be suppressed even when the toner is used under severe environments of a low temperature/low humidity or a high temperature/high humidity for a long time.

When the particulate of less than about 0.5 wt % is included in the first specific weight, region, a toner may be more susceptible to degradation in case when an unsuspected external force acts on the toner instantly, while when the particulate of greater than about 9 wt % is included in the first specific weight region, a filming performance may be deteriorated.

When the particulate of less than about 0.5 wt % is included in the second specific weight region, a toner may be more susceptible to degradation in case when an unsuspected external force acts on the toner instantly, while when the particulate of greater than about 6 wt % is included in the second specific weight region, a filming performance may be deteriorated.

According to one embodiment, when an unsuspected external force acts on the toner instantly, it is expected that the particulates within the specific weight region ranges are preferentially destructed and thereby degradation of the toner may be suppressed.

In the specific weight distribution according to an embodiment, because only two regions of the first specific weight region and the second specific weight region are defined, it may be confirmed whether a particulate satisfies Property (8) simply and efficiently or not by measuring only representative regions.

A detailed method of measuring the specific weight distribution is as follows.

First, a first aqueous solution having a reference specific gravity ($d_{1.001.00}$) based on a value ($d_{1.001.00}$) of a true specific gravity according to Property (3), a second aqueous solution having a specific gravity ($d_{0.95}$) that is 0.95 times the first aqueous solution, and a third aqueous solution having a specific gravity ($d_{0.90}$) that is 0.9 times the first aqueous solution, three kinds of aqueous solutions are prepared.

Precisely weighed particulates are added to each of the three kinds of aqueous solutions and dispersed.

On the other hand, before addition of aqueous solutions, the particulate may be dipped in liquid including a surfactant and an organic solvent such as acetone or other solvents so that the surface may have hydrophilicity. In this case, agglomeration between the added particulates may be prevented and the particulate may be sufficiently dispersed in aqueous solutions.

After adding of the particulate, an ultrasonic wave may be applied to each of the aqueous solution to promote dispersion of the particulate.

The particulate is not agglomerated and after confirming that primary particles are dispersed well, solid-liquid separation is performed using centrifugation.

Herein, the dispersion of primary particles may be, for example confirmed by a particle distribution measuring device, or a scanning electron microscope (SEM).

An example of the particle distribution measuring device may be a dynamic light scattering particle distribution (ELSZ1000ZS, Otsuka Electronics), and the SEM may be SU8020 of Hitachi, Ltd.

Then, a supernatant is removed through a decantation and washing with ion exchange water is performed several times. After sufficient washing, a sedimented particulate is dried using a lyophilization method and a weight of the dried particulate is measured precisely.

Then, a component ratio of the particulates in the first and second specific weight regions is calculated using weights of each particulate obtained through each of the three kinds of aqueous solutions. Herein, a total weight ($W_{tot}$) of the particulates in the aqueous solutions is set to be the same value for each of the three aqueous solutions.

An amount of the particulate included in the first specific weight region may be calculated by dividing a difference ($W_{1.01.000}-W_{0.95}$) between a first weight ($W_{1.01.000}$) of the sedimented particulate measured using the first aqueous solution and a second weight ($W_{0.95}$) of the sedimented particulate measured using the second aqueous solution by the total weight ($W_{tot}$) of the particulate.

In the same way, an amount of the particulate included in the second specific weight region may be calculated by dividing a difference ($W_{0.95}-W_{0.90}$) between a second weight (Wags) of the sedimented particulate measured using the second aqueous solution and a third weight ($W_{0.90}$) of the sedimented particulate measured using the third aqueous solution by the total weight ($W_{tot}$) of the particulate.

The specific weight distribution and the first and second specific weight regions may be obtained by using a different measuring method and/or device in addition to the measuring method and/or the device. However, even if the specific weight distribution and first and second, specific weight regions are different from the value ranges measured by the other measuring methods, they belong to Property (8) according to an embodiment as long as the results measured by a method of measuring a specific weight distribution and first and second specific weight regions of the particulate according to the embodiment belong to Property (8) ranges according to an embodiment.

Property (9): Loss on Heating

Property (9) of the particulate according to an embodiment is a loss on heating of the particulate. The particulate satisfying Property (1), Property (3), and Property (8) or satisfying Property (1), Property (3), and Property (8) and additionally Property (2) may satisfy Property (9).

The loss on heating of the particulate according to an embodiment may be for example about 3 wt % to about 10 wt % when a temperature is increased from room temperature.

The room temperature may generally refer to about 23° C., for example, about 20° C. to about 25° C.

When a temperature is increased, an approach temperature may be different according to a material or a producing process of the particulate, but may be representatively about 500° C.

That is, the loss on heating of the particulate according to an embodiment refers to a mass loss when a temperature is increased up to about 500° C. from room temperature, and decreased mass indicates the remaining water amount in the particulate and the amount of residuals not participated in a condensation polymerization reaction of silicone compound.

The moisture amount in the particulate effects the electrification of particulate, which effects adhesion properties to the toner particle when being externally added.

Accordingly, adhesion properties to the toner particle when being externally added may be controlled at an appropriate level and thus degradation of the toner may be suppressed by controlling the loss on heating, and particularly, even if excessive charges are imparted to the particulate under a low temperature/low humidity environment, image degradation may be suppressed by maintaining a moisture amount appropriately and suppressing excessive electrification. In addition, by controlling the loss on heating, a toner coalesce on the photoreceptor surface which are causes for the member contamination or a underlayer formation on a development member are prevented and thereby image degradation may be suppressed.

Herein, the loss on heating of the particulate according to Property (9) is about 3 wt % to about 10 wt % as described above.

When the loss on heating is less than about 3 wt %, a quantity of electric charge of the particulate is excessively increased and thus toner coalesce on the photoreceptor surface or a underlayer formation on a development member may not be prevented and image degradation may not sufficiently suppressed.

In addition, when the loss on heating is greater than about 10 wt %, a quantity of electric charge of the particulate is excessively lowered and the particulate may be easily left from the toner particle and degradation of a toner is difficult to suppress. Particularly, when an excessive charge is imparted to the particulate under a low temperature/low humidity environment, excessive electrification may not be suppressed and image degradation may occur. On the other hand, when the loss on heating is greater than about 10 wt %, residue materials which do not participate in a condensation polymerization of silicon compound remain excessively and thus a strength of the particulate itself may be deteriorated.

The loss on heating of the particulate according to Property (9) may be measured by a thermogravimetry/differential thermal simultaneous analysis (TGDTA). More specifically, a predetermined amount of the particulate is put into an aluminum container under the argon (Ar) atmosphere, and the aluminum container is introduced into a device for measuring the thermogravimetry/differential thermal simultaneous measuring device (TG/DTA6200, manufactured by Seiko Instrument) and heated from the room temperature to about 500° C. at a rate of about 10° C./minute.

The weight of an aluminum container is weighed by a balance in the measuring device during the heating. After completing the heating, the difference between after the heating and before the heating is compared to obtain the loss on heating.

The loss on heating may be obtained by using a different measuring method and/or device in addition to the measuring method and/or the device. However, even if a loss on heating is different from the value ranges measured by the other measuring methods, it belongs to Property (9) according to an embodiment as long as the results measured by a method of measuring a loss on heating according to the embodiment belongs to Property (9) ranges according to an embodiment.

The external additive for a toner according to an embodiment may further include particulate additives consisting of other materials different from the particulate in addition to the particulate having the properties. The particulate additives may include any materials as long as they do not change the properties of the particulate. For example, the external additive for a toner according to an embodiment may include a particulate additive having a smaller particle diameter than the particulate. The particulate additive may be added in an appropriate amount in order to impart fluidity of a toner particle. Examples of the particulate additive may be, for example a hydrophobic silica particulate having a hydrophobic group on the surface, but embodiments are not limited thereto.

B-1. Process for Producing External Additive for Toner (1)

A process for producing an external additive for a toner according to an embodiment includes a preparation process for preparing particulate dispersion liquid and a particulate hydrophobizing process. Using the producing process, the particulate having desired properties may be prepared. Hereinafter, each step of the process for producing an external additive for a toner is described.

Preparation Process of Particulate Dispersion Liquid

The preparation process includes mixing a silicon-containing component including a silicon compound represented by Chemical Formula 1: $Si(OR^1)_4$ with a catalyst-containing component including a basic compound, and performing a condensation polymerization reaction of the silicon compound in the mixed solution to form particulate dispersion liquid.

Herein $R^1$ is a C1 to C6 monovalent hydrocarbon group.

The condensation polymerization reaction of the silicon compound in the preparation process of particulate dispersion liquid may be performed by a first process of obtaining a silicon compound solution, a second process of obtaining a mixed solution, and a third process of obtaining particulate dispersion liquid.

Hereinafter, each step of the preparation process of particulate dispersion liquid is described.

<A. Preparation of Silicon Compound Solution (First Process)>

The silicon compound solution may be prepared by dissolving the silicon compound represented by Chemical Formula 1 (hereinafter, referred to as Component A1) in a solution including an organic solvent.

The silicon compound is a raw material of a silica particulate and may include a tetrafunctional silane compound represented by Chemical Formula 1, or a hydrolysis-condensation product thereof.

The tetrafunctional silane compound as a monomer may be a silane compound, for example tetramethoxysilane (TMOS), tetraethoxysilane (TEOS), tetrapropoxysilane, tetrabutoxysilane, and other silanes, but embodiments are not limited thereto.

The hydrolysis-condensation product of the tetrafunctional silane compound is a hydrolysis-condensation product obtained by a condensation reaction of a functional group having hydrolytic properties such as a methoxy group or an ethoxy group of the tetrafunctional silane compound, and may be a dimer or an oligomer, but an example embodiment is not limited thereto.

The silicon compound solution according to an embodiment may include a silicon compound backbone in order to control properties of the particle. A content of the silicon compound in the silicon compound solution may be appropriately determined by considering the kind of silicon compound and a composition amount of the silicon compound required to obtain a silica particulate.

For example, the content of the silicon compound based on a total amount of the mixed solution may be, for example, greater than or equal to about 3 wt %, or greater than or equal to about 1 wt %, and for example, less than or equal to about 50 wt % or less than or equal to about 45 wt %.

When the content of the silicon compound is less than about 1 wt %, an absolute amount of the silicon compound in the mixed solution may be too low to provide a sufficient raw material of the particulate prepared by the condensation polymerization reaction of the silicon compound, and it may be difficult to prepare a particulate having a strong durability.

In addition, when the content of the silicon compound is greater than about 50 wt %, the content of the silicon compound may be excessively high and reaction residues which do not participate in the condensation polymerization reaction may remain in the mixed solution.

The organic solvent may be determined considering the kind of silicon compound, the compatibility with the catalyst-containing component or other factors. For example, the organic solvent may include a protic solvent, an aprotic solvent or other solvents, but the scope of the present invention is not limited thereto.

The protic solvent may include, for example, ethanol, propanol, isopropanol or other protic solvents, and the aprotic solvent may include, for example, acetonitrile, tetrahydrofuran, dioxane or other aprotic solvents.

For example, when the protic solvent and the aprotic solvent are used for the silicon-containing component, a balance of two kinds of solvents may be important for the condensation polymerization reaction of the silicon compound.

A content ratio (weight ratio) of the aprotic solvent and the protic solvent may be, for example about 1:99 to 99:1, for example about 5:95 to 95:5. When the content ratio of the two solvents is out of the range, a balance of two solvents may be unfavorable, and it may inhibit performing the condensation polymerization reaction of the silicon compound On the other hand, a content of the organic solvent in the silicon-containing component may be determined considering the kind of silicon compound being used, compatibility with the used silicon compound, and a composition amount of the silicon compound that may be required to obtain a usable particulate.

More specifically, a content of the organic solvent based on a total amount of the mixed solution until the third process of obtaining particulate dispersion liquid is completed may be, for example greater than or equal to about 50 wt %, and for example less than or equal to about 99 wt %, for example less than or equal to about 95 wt %.

When the content of the organic solvent is less than about 50 wt %, the content of the silicon compound may be excessively large and remaining silicon compounds which do not participate in the condensation polymerization reaction may remain in the mixed solution, while when it is greater than about 99 wt %, an absolute amount of the silicon compound may be too low to provide a sufficient raw material of the particulate prepared by the condensation polymerization reaction of the silicon compound, and it may be difficult to prepare a particulate having a strong durability.

<b. Preparation of Mixed Solution (Second Process)>

In the second process, a solution including a basic compound (hereinafter, referred to as Component B1) and water as a catalyst is added to the silicon compound solution to prepare a mixed solution.

As for the basic compound, it may have high volatility so as to be removed by a fourth process which will be described later. In this case, the basic compound may be, for example, ammonia, methylamine, dimethylamine, diethylamine, triethylamine, and other amines, but embodiments are not limited thereto.

In addition, a solvent for Component B1 may have compatibility with the basic compound and the silicon compound, and may be a solvent added to water, for example, an aqueous solvent such as methanol or ethanol, but embodiments are not limited thereto.

Content of the basic compound in the catalyst-containing component may be determined considering compatibility with the silicon compound and a composition amount of the silicon compound required to obtain a usable particulate based on a total amount of the mixed solution.

Content of the basic compound in the catalyst component in an embodiment may be greater than or equal to about 0.1 wt %, for example, greater than or equal to about 0.5 wt %, greater than or equal to about 1 wt %, greater than or equal to about 3 wt %, and for example, less than or equal to about 40 wt %, less than or equal to about 30 wt %, or less than or equal to about 20 wt % in each of the second process and a post-described third process.

When the content of the basic compound is less than about 0.1 wt %, the content of the basic compound required for a role of a catalyst of the condensation polymerization reaction of the silicon compound may be insufficient, while when it is greater than about 40 wt %, the condensation polymerization reaction of the silicon compound may be excessively performed.

In the second process according to an embodiment, during preparation of the mixed solution, the mixed solution may be stirred. An agitation speed of the mixed solution may be different according to a shape or a size of a used mixing container, and may be for example, about 30 rpm to about 600 rpm, for example, about 80 rpm to about 300 rpm.

When the agitation speed of the mixed solution is less than about 30 rpm, the silicone compound in the silicon-containing component and the basic compound in the catalyst-containing component may be less contacted and the condensation polymerization reaction of the silicon compound may not be performed sufficiently, while when the agitation speed of the mixed solution is greater than about 600 rpm, contacts of silicon particulates may become larger and thus it may not grow the particulate sufficiently.

The agitation speed may be constantly maintained for all steps including before the mixing, during the mixing, and after the mixing, or it may be changed in the various speeds as long as it does not inhibit the growth of the particulate.

During the preparation of the mixed solution, a temperature of each solution may be the same temperature, and during a mixing process, they may be desirably controlled to have the same temperature. The temperature may be about 0° C. to about 60° C.

When it is less than about 0° C., a condensation polymerization reaction for forming a silicon particulate may become slow and productivity may become unfavorable, while when it is greater than 60° C., a size distribution of the produced silicon particulate may become wider and a generation ratio of the coarse particulate may become larger.

<c. Preparation of Particulate Dispersion Liquid (Third Process)>

In the third process, at least one of the silicon compound and the basic compound may be further added to and mixed with the mixed solution prepared in the second process of preparing particulate dispersion liquid, which is performed once or more.

The coarse particulate having a particle diameter of greater than or equal to about 1 μm may consist of agglomerates as described above and a production ratio thereof may have a relationship with a concentration of the particulate.

In an embodiment, the silica particulate may be formed in the second process and the third process.

In this way, by preparing small amounts of the particulate dispersion liquid multiple times, the particulate concentration is prevented from increasing to a concentration at which a large number of coarse particulates are generated until the third process is completed. In addition, generation of a high local particulate concentration in the dispersion liquid is prevented.

Therefore, the silica particulate dispersion liquid prepared through the third process according to an embodiment has a low presence ratio of coarse particulates.

In the third process according to an embodiment, the number of times the at least one of the silicon compound and the basic compound are added and mixed is not particularly limited, and continuous additions (that correspond to infinite times) may be performed.

In addition, in an embodiment, from the first process and to the third process when number of times the silicon compound is added is referred to as m and the number of times the basic compound is added is referred to as n, m+n may be greater than or equal to about 3.

The silicon compound added in the third process is a tetrafunctional silane compound represented by Chemical Formula 1 or a hydrolysis-condensation product thereof and hereinafter, referred to as Component Ai. In Ai, i denotes an order of addition and has a value of greater than or equal to 2. $R^1$ is C1 to C6 monovalent hydrocarbon group.

The tetrafunctional silane compound as a monomer may be a silane compound such as, for example, tetramethoxysilane (TMOS), tetraethoxysilane (TEOS), tetrapropoxysilane, tetrabutoxysilane, and other silanes, but embodiments are not limited thereto.

The hydrolysis-condensation product of the tetrafunctional silane compound is a hydrolysis-condensation product obtained by a condensation reaction of a functional group having hydrolytic properties such as a methoxy group or an ethoxy group of the tetrafunctional silane compound, and may be a dimer or an oligomer, but an example embodiment is not limited thereto.

In addition, Component Ai may be the same as or different from Component A1.

For example, in the first process, when tetraethoxysilane is used as Component A1, in the third process, tetraethoxysilane or tetramethoxysilane may be used as Component A2.

Even when the silicon compound is added multiple times in the third process, the silicon compound at each time may be the same or different. For example, when tetraethoxysilane is used as Component A2, tetraethoxysilane or tetramethoxysilane may be used as Component

A3.

In an embodiment, a basic compound added in the third process is referred to as Component Bj. Herein, j denotes an order of addition and has a value of greater than or equal to 2. Component Bj may have high volatility so as to be removed by a fourth process which will be described later, and may be, for example, ammonia, methylamine, dimethylamine, diethylamine, triethylamine, and other amines. However, embodiments are not limited thereto.

On the other hand, Component Bj may be the same as or different from Component B1.

For example, in the first process, when ammonia is used as Component B1, in the third process, ammonia or dimethylamine may be used as Component B2.

Even when the basic compound is added multiple times in the third process, the basic compound at each time may be the same or different. For example, when ammonia is used as Component B2, ammonia or dimethylamine may be used as Component B3.

In the third process, Bj may be added with water and a water-soluble solvent.

In the third process, when the silicon compound and the basic compound are added together, it is desirable that the silicon compound is added and then the basic compound is added. By adding the silicon compound first rather than basic compound, a silica particulate having a minimized deviation of a particle diameter may be formed.

When a weight of the organic solvent is referred to as $W_o$ in the first process and a maximum weight of the silicon compound that added once of the first process and the third process is referred to as $W_s$, $W_s/W_o$ may be less than or equal to about 0.15.

Thereby, each concentration of the silicon compound is lowered to be dispersed in a solution sufficiently, and thus generation of agglomerates may be suppressed. Therefore, when the condition is satisfied, particulate dispersion liquid having a low presence ratio of coarse particulates may be prepared.

A temperature of each solution in the third process may be the same as a temperature of the mixed solution prepared through the second process and during a mixing process, they may be desirably controlled to have the same temperature. The temperature may be about 0° C. to about 60° C.

When it is less than about 0° C., a condensation polymerization reaction for forming a silicon particulate may become late and productivity may become unfavorable, while when it is greater than 60° C., a size distribution of the produced silicon particulate may become wider and a generation ratio of the coarse particulate may become larger.

Particulate Hydrophobizing Process

The particulate hydrophobizing process is a process of obtaining a hydrophobized silica particulate from the particulate dispersion liquid and includes a fourth process of removing the basic compound, a fifth process of combining polar groups on the particulate surface, and a sixth process of introducing a hydrophobic group on the particulate surface to hydrophobize the particulate surface.

Hereinafter, the fourth to sixth processes are described as follows.

<a. Process of Removing Basic Compound (Fourth Process)>

When the basic compound is present on the surface of the particulate, electrification of the particulate is inhibited and thus performance of the external additive may be degraded and it may be difficult to hydrophobize. Therefore, the fourth process of heat-treating the particulate in liquid and removing the basic compound on the surface of the particulate is performed. The liquid in an embodiment may be water such as distilled water but may be a non-basic aqueous solution.

The process of removing the basic compound may be, for example, performed as follows.

Centrifugation and decantation of the particulate dispersion liquid (silica sol) obtained by the third process are performed to separate a solid and liquid from the particulate dispersion liquid. Then, water is added to the solid to obtain a water-dispersed sol of a particle consisting of silica. The sol is heat-treated and solid-liquid separation is performed using centrifugal sedimentation.

After removing liquid including the basic compound by performing the water addition and solid-liquid separation several times, the resultant is dried using a drying method such as a lyophilization method in which it is difficult to make agglomerates to obtain a powder consisting of the particulate.

In an embodiment, a heat treatment temperature (a removal temperature) T1 of the fourth process may be greater than or equal to about 60° C. and less than or equal to about 100° C. and a heat treatment time (a removal time) t1 may be less than or equal to about 8 hours, for example, about 3 hours to about 8 hours.

When the removal temperature (T1) is less than about 60° C., it may be difficult to remove the basic compound from the surface of the particle and also remove (evaporated) from water, and thus the basic compound may be difficult to be removed sufficiently.

Because water is used, an upper limit of the removal temperature (T1) is 100° C.

When the removal time (t1) is greater than about 8 hours, the particulate may form agglomerates and as a result a presence ratio of the coarsened particulate may increase. Therefore, according to an embodiment, when the removal time (t1) is greater than or equal to about 3 hours, a removal ratio of the basic compound may be increased.

In addition, by the fourth process, the basic compound is removed from the surface of the particulate and simultaneously binding groups on the particle surface are partly bound to each other to hydrophobize the surface.

<b. Combining Process of Polar Group (Fifth Process)>

Because the surface of the particulate has hydrophilicity due to a polar group on the surface, in the fifth process, the particulate obtained by the fourth is heat-treated in liquid and polar groups on the particulate surface are combined to hydrophobize the particulate surface. The polar group may be a silanol group and the liquid may be water, methylisobutylketone, diisobutylketone, and other ketones.

The heat treatment temperature (treatment temperature) T2 may be, for example, about 80° C. to about 150° C., for example about 100° C. to about 120° C. The heat treatment time (treatment time) t2 may be, for example less than or equal to about 12 hours, for example, about 3 hours to about 12 hours.

When the treatment temperature T2 is less than about 80° C., combinations of the polar groups on particulate surface may not be sufficient and thus sufficient hydrophobization effect may not be obtained, while when the treatment temperature T2 is greater than about 150° C., particulates may be bound to form agglomerates and thereby a presence ratio of the coarse particulate may increase.

On the contrary, when the treatment temperature T2 satisfies about 100° C. to about 120° C., polar groups on the particulate surface may sufficiently combine and a sufficient hydrophobization effect may be obtained and binding of the particulates may be suppressed.

When the treatment time t2 is greater than about 12 hours, the particulate may form agglomerates and a presence ratio of the coarse particulate may increase. When the treatment time t2 is greater than or equal to about 3 hours, binding between the polar groups on the silica surface may increase. Binding between the polar groups on the surface may be, for example, evaluated by a methyl red titration method.

As described above, binding between the polar groups on the particulate surface may occur in the fourth process. Therefore, while sufficient hydrophobization is performed through binding between the polar groups on the particulate surface, it may be desirable to manage the amount of heat provided to the particulates through the fourth process and the fifth process in order to suppress binds between the particulates.

According to an embodiment, when $(T1\times t1)+(T2\times t2)$ is a relationship of 480° C.·hr to 2600° C. hr, sufficient hydrophobization is available and simultaneously generation of a coarse particulate consisting of agglomerates may be suppressed.

When $(T1\times t1)+(T2\times t2)$ is less than 480° C.·hr, binding between the polar groups on the particulate surface may not be sufficient and thus, hydrophobization may not be sufficient, while when $(T1\times t1)+(T2\times t2)$ is greater than 2600° C.·hr, binding between the particulates may occur to generate agglomerates and thus, a presence ratio of the coarse particle may increase.

<c. Process of Introducing Hydrophobic Group (Sixth Process)>

The sixth process is a process of hydrophobizing the particulate by reacting a part of remaining hydroxy group (OH group) on the particulate surface of the particulate obtained by the fifth process with a hydrophobization agent to introduce a hydrophobic group.

The hydrophobic group introduced into the particulate surface is not particularly limited as long as it is suitable for hydrophobizing the particulate surface and may be, for example, a trialkylsilyl group, a dialkylsilyl group, a monoalkylsilyl group, a phenyl group-containing silyl group, and other groups containing a silyl group.

Hereinafter, an example of the sixth process is described using a trialkylsilyl group as the hydrophobic group being introduced.

In the particulate hydrophobizing process according to an embodiment, the particulate surface is contacted with at least one of a silazane compound represented by Chemical Formula 2: $R^2{}_3SiNHSiR^2{}_3$ and a silane compound represented by Chemical Formula 3: $R^3{}_3SiX$ as a hydrophobization agent to introduce the trialkylsilyl group on the surface and thus to hydrophobize the particulate surface.

$R^2$ is a C1 to C6 monovalent hydrocarbon group, $R^3$ is a C1 to C6 monovalent hydrocarbon group, and X is a hydroxy group or a hydrolytic group.

The at least one kind of compound acts as a hydrophobization agent of trialkysilylating the hydroxyl group that remains on the particulate surface after the condensation polymerization reaction of the silicon compound.

In the sixth process, a reaction temperature may be about 20° C. to about 150° C., for example, about 30° C. to about 120° C. Within the reaction temperature range, the hydrophobization may be performed by introducing the trialkylsilyl group rapidly and sufficiently.

An internal pressure of a reaction vessel used in the sixth process may be a normal pressure, or a higher pressure than the normal pressure, for example, about 760 mmHg to about 850 mmHg. Within the pressure range in the reaction vessel, the hydrophobization may be performed by introducing the trialkylsilyl group rapidly and sufficiently.

As for the hydrophobization agent, the silane compound represented by Chemical Formula 2 may be, for example hexamethyldisilazane (HMDS), trimethylsilylchloride, and hydrophobic silanes, but embodiments are not limited thereto.

As for the hydrophobization agent, the silane compound represented by Chemical Formula 3 may be, for example methyltrimethoxysilane, dimethyldimethoxysilane, dimethyldiethoxysilane, isobutyltrimethoxysilane, methacryloyloxypropyltrimethoxysilane, phenyltrimethoxysilane, and other silanes, but embodiments are not limited thereto.

Meanwhile, a hydrolytic group represented by X of Chemical Formula 3 may be, for example, a methoxy group, an ethoxy group, a propoxy group, a butoxy group, and the like, but embodiments are not limited thereto. Or (and), a hydrolytic group in X of the formulae representing the silane compound may be a methoxy group, an ethoxy group, a propoxy group, a butoxy group, and other alkoxy, but is not limited thereto.

A solvent of the silazane compound or the silane compound, functioning as the hydrophobization agent, may include, for example, an aqueous solvent such as water or an organic solvent such as acetone, methylethylketone, methylisobutylketone, methanol, ethanol, isopropanol, and other solvents.

The particulate of the external additive for a toner prepared by the process for producing an external additive for a toner may satisfy Properties (1) to (4) or one or more of Properties (5) to (7) in addition to Properties (1) to (4), B-2. Process for Producing External Additive for Toner (2)

According to an embodiment, an external additive for a toner may be prepared by a particulate recovering process and a particulate hydrophobizing process instead of performing the third process to the sixth process for the mixed solution prepared by the second process of the process for producing an external additive for a toner (1).

Particulate Forming Process

<a. Preparation of Silicon Compound Solution (First Process)>

This process is the same as the first process of the preparation process of particulate dispersion liquid of the process for producing an external additive for a toner (1).

<b. Preparation of Mixed Solution (Second Process))>

This process is the same as the second process of the preparation process of particulate dispersion liquid of the process for producing an external additive for a toner (1). But, a composition ratio (weight ratio) of the silicon-containing component and the catalyst-containing component in the mixed solution prepared by the second process may be, for example, about 10:90 to about 90:10, for example, about 30:70 to about 85:15. When the composition amount of the silicon-containing component relative to a total amount of the mixed solution is small, a raw material of the silica particulate prepared by the condensation polymerization reaction of the silicon compound may be insufficient, while when the composition amount of the catalyst-containing component relative to a total amount of the mixed solution is small, a catalyst required for a condensation polymerization reaction of the silicon compound may be insufficient.

The first reaction step and the second reaction step for the mixed solution are performed to form a particulate from the particulate dispersion liquid.

<c. First Reaction Step>

The first reaction step refers to an overall step of the condensation polymerization reaction after the mixed solution preparing process, and the first reaction step may control to be applied with lower amount of heat than in the second reaction so that a required particulate structure backbone is constructed and, simultaneously, may control to apply sufficient amount of heat to the following second reaction step so that the particulate specific structure is controlled.

In the first reaction step, the mixed solution stirred in the mixing process is maintained at the first reaction temperature (T3) for the third reaction time (t3).

The first reaction temperature (T3) may be, for example, greater than or equal to about 2° C., greater than or equal to about 5° C. and for example, less than or equal to about 60° C. or less than or equal to about 45° C.

When the first reaction temperature (T3) is less than about 2° C., the particulate backbone to be obtained in the first reaction step may be difficult to obtain, while when it is greater than about 60° C., the particulate backbone may be too fixed to precisely control the particulate in the subsequent second reaction step.

The first reaction temperature (T3) may be set to be the same temperature as a temperature (TA) of the silicon-containing component and a temperature (TB) of the catalyst-containing component during the mixing process. In this case, the thermal stress applying to the growing silica particulate in the mixed solution in the mixing and first reaction step may be minimized.

In addition, a method of controlling the first reaction temperature (T3) from the temperature of the mixed solution may include any method capable of rapidly transmitting from the mixed process to the first reaction step without affecting the condensation polymerization reaction of the silicon compound.

The first reaction time (t3) refers to a time right after obtaining a mixed solution by mixing the silicon-containing component and the catalyst-containing component at a time and does not include a time taken to be transmitted to the second reaction step.

The first reaction time (t3) may be set to be the same or shorter than the second reaction time (t4) to apply less amount of heat to the particulate than the second reaction step.

For example, the first reaction time (t3) may be, for example, about 1 hour to about 10 hours, for example, about 1 hour to about 5 hours.

When the first reaction time (t3) is less than about 1 hour, the amount of heat applied to the mixed solution in the first reaction step may be too low to perform the condensation polymerization reaction of the silicon compound.

When the first reaction time (t3) is greater than about 10 hours, heat applied to the mixed solution in the first reaction step may be excessively high, so that the condensation polymerization reaction of the silicon compound may be excessively performed.

In the first reaction step, an agitation speed of the mixed solution may be, for example, about 50 rpm to about 300 rpm, for example, about 80 rpm to about 250 rpm.

The agitation speed may be constantly maintained for overall the first reaction step, but it may be changed in the various speeds within the range as long as it does not inhibit growing silica particulate.

After completing the first reaction step and before starting the second reaction step, a temperature of the mixed solution is changed from the first temperature (T3) to a second reaction temperature (T4), which is a transition step.

In the transition step, the temperature of the mixed solution is slowly increased from the first reaction temperature (T3) to the second reaction temperature (T4). A temperature increasing rate in the transition step may be, for example, about 0.1° C./min to about 5° C./min, for example, about 0.3° C./min to about 3° C./min.

When the temperature increasing rate is less than about 0.1° C./minute, the transition time from the first reaction step to the second reaction step may be too prolonged to rapidly perform the second reaction step; when the temperature increasing rate is greater than about 5° C./minute, the temperature change may be excessively large and the thermal stress to the condensation polymerization may be too high to sufficiently perform the condensation polymerization.

<d. Second Reaction Step>

The second reaction step corresponds to the second half step of the condensation polymerization after the first reaction step. In the second reaction step, the amount of heat higher than in the first reaction step is applied, and it further controls the particle structure by carrying out the condensation polymerization on the backbone formed by the first reaction step, so that it may provide a particulate dispersion controlled to provide desirable properties.

In the second reaction step, after the first reaction step, the stirred mixed solution is maintained at the second temperature (T4) for the second reaction time (t4).

Because the second reaction step is a step for mainly performing the condensation polymerization reaction, the second reaction temperature (T4) is set to be higher than the second reaction temperature (T3). For example, the second reaction temperature (T4) may be about 5° C. to about 70° C., for example about 15° C. to about 70° C.

When the second reaction temperature (T4) is less than about 5° C., it may be difficult to perform the condensation polymerization reaction of the silicon compound, and when it is greater than about 80° C., the condensation polymerization reaction may occur too rapidly to precisely control.

The second reaction time (t4) is a step for mainly performing the condensation polymerization reaction as described above and may be set to be greater than or equal to the first reaction time. For example, the second reaction time may be about 1 hour to about 20 hours, for example, about 2 hours to about 15 hours.

When the second reaction time (t4) is less than about 1 hour, the condensation polymerization reaction of the silicon compound may be difficult to be performed sufficiently, while when it is greater than about 20 hours, the condensation polymerization reaction of the silicon compound may be performed excessively.

The agitation speed of the mixed solution in the second reaction step may be, for example, about 50 rpm to about 300 rpm, for example, about 80 rpm to about 250 rpm. The agitation speed may be constantly maintained for overall the second reaction step, but it may be changed in the various speeds within the range as long as it does not inhibit growing silica particulate.

In the particulate forming process, a growth direction of the silica particulate is determined by the mixing process, heat is imparted to the mixed solution by the first reaction step to initiate a growth process of the silica particulate, a sufficient heat is imparted to the mixed solution by the second reaction step to perform a full-scale growth process of the silica particulate, and reaction sites where the condensation polymerization reaction is not performed participate in the reaction sufficiently to perform a growth of the silica particulate.

The prepared silica particulate may satisfy Property (1), Property (3), and Property (8), or one or more of Property (6) and Property (9) in addition to Property (1), Property (3), and Property (8).

Particulate Recovering Process

The particulate recovering process is a process of recovering a particulate from the particulate dispersion obtained from the particulate forming process. During the process, only particulate is separated from the particulate dispersion and recovered.

The recovering method is not particularly limited as long as the surface or the shape of particulate in the dispersion is not changed, and the particulate is not damaged. For example, it may include heating using an evaporator, a solid-liquid separation using a centrifugal settler, a freeze-drying method or other techniques.

The silica particulate recovered by the particulate recovering step may satisfy Property (1), Property (3), and Property (8), or one or more of Property (6) and Property (9) in addition to Property (1), Property (3), and Property (8).

Particulate Hydrophobizing Process

The particulate hydrophobizing process is a process of hydrophobizing the particulate surface by reacting the hydrophobization agent with hydroxyl group (—OH) partially remained on the particulate surface and introducing the hydrophobic group onto the particulate surface to hydrophobize the particulate surface.

In the particulate hydrophobizing process, the particulate may be hydrophobized according to the kind of toner to be added, the usage of toner, or other variables, or may be omitted. The particulate hydrophobized by the particulate hydrophobizing process may be the particulate recovered from the particulate recovering process or the sol particulate dispersion formed from the particulate forming process. The former may be prepared by sequentially performing the particulate forming process, the particulate recovering process, and the particulate hydrophobizing process; the latter may be prepared by sequentially performing the particulate forming process, the particulate hydrophobizing process, and the particulate recovering process.

It may use trialkylsilyl group as the hydrophobic group on the surface of particulate to provide the particulate with hygroscopicity reducing effects and to maintain the external additive and toner with the appropriate quantity of electric charge, but the scope of the present disclosure is not limited thereto. The hydrophobic group may include various hydrophobic groups capable of applying hydrophobicity on the particulate surface, for example, at least any one of a trialkylsilyl group, a triphenylsilyl group, a diphenylmonoalkylsilyl group, and a dialkylmonophenylsilyl group.

Hereinafter, hydrophobization of the particulate is described using trialkylsilyl group as an example of the hydrophobic group.

In the particulate hydrophobizing process according to an embodiment, the particulate surface is contacted with at least one of a silazane compound represented by Chemical Formula 2: $R^2_3SiNHSiR^2_3$ and a silane compound represented by Chemical Formula 3: $R^3_3SiX$ to introduce the trialkylsilyl group on the surface and thus, hydrophobizing the particulate surface.

The at least one kind of compound acts as a hydrophobization agent by trialkysilylating the hydroxyl group (—OH) remaining on the particulate surface after the condensation polymerization of the silicone compound.

One example of contacting the hydrophobization agent to the particulate surface may include mixing the particulate dispersion obtained from the particulate forming process with a solution including a hydrophobization agent; mixing the solution including particulate recovered from the particulate recovering process with a solution including a hydrophobization agent; or adding a solution including a hydrophobization agent onto the surface of particulate recovered from the particulate recovering process, but the scope of the present disclosure is not limited thereto.

Meanwhile, the reaction temperature in the particulate hydrophobizing process in which the trialkylsilyl group is added on the particulate surface may be, for example, about 20° C. to about 120° C., for example, about 30° C. to about 95° C.

When the particulate is performed with the hydrophobization reaction within the reaction temperature range, the hydrophobization may be rapidly and sufficiently performed by a trialkylsilyl group.

In addition, the inside pressure of the reaction vessel (hereinafter, referred to pressure in the reaction vessel) used in the particulate hydrophobizing process of adding trialkylsilyl group on the particulate surface may be the normal pressure (760 mmHg) or the pressure greater than or equal to the normal pressure, for example, about 760 mmHg to about 850 mmHg.

When the particulate is performed with the hydrophobization reaction within the pressure range in the reaction vessel, the hydrophobization may be rapidly and sufficiently performed by the trialkylsilyl group.

Meanwhile, the silazane compound represented by Chemical Formula 2 may include, for example, hexamethyldisilazane (HMDS), trimethylsilyl chloride or other siliazane compounds, but the scope of the present disclosure is not limited thereto.

Meanwhile, the silane compound represented by Chemical Formula 3 and selected as at least one kind of the compounds and having a function of the hydrophobization agent, may include, for example, methyltrimethoxysilane, dimethyldimethoxysilane, dimethyldiethoxysilane, isobutyltrimethoxysilane, methacryloyloxypropyltrimethoxysilane, phenyltrimethoxysilane or other silanes, but the scope of the present disclosure is not limited thereto.

Meanwhile, as hydrolytic functional group represented as X in Chemical Formula 3 may include, for example, methoxy group, ethoxy group, propoxy group, butoxy group or other alkoxy groups, but the scope of the present disclosure is not limited thereto.

A solvent of silazane compound or silane compound, functioning as the hydrophobization agent, may include, for example, an aqueous solvent such as water or an organic solvent such as acetone, methylethylketone, methylisobutylketone, methanol, ethanol, isopropanol, and other solvents.

When the silica particulate surface is hydrophobized using liquid including the hydrophobization agent, an agitation speed of the liquid including the hydrophobization agent may be set to be, for example, about 50 rpm to about 300 rpm, for example, about 80 rpm to about 250 rpm. The agitation speed may be constantly maintained for overall the hydrophobizing reaction process, but it may be changed in the various speeds within the range as long as it does not inhibit a hydrophobizing reaction.

The silica particulate prepared by the process for producing an external additive for a toner may satisfy Property (1), Property (3), and Property (8), or one or more of Property (6) and Property (9) in addition to Property (1), Property (3), and Property (8).

C, Toner

A toner according to an embodiment may be obtained by externally adding the external additive for a toner to a surface of a toner mother particle.

First, a toner mother particle is prepared to provide a toner. The toner mother particle may be a resin particle. For example, a resin is firstly prepared from the raw material to prepare the toner mother particle. Subsequently, the resin and a colorant are mixed and, if required, further mixed with a charge control agent and a release agent to provide a resin mixture.

The obtained resin mixture is melt-kneaded to provide a kneaded material, and the kneaded material is coarsely ground, and then the coarsely ground material is pulverized and fractioned to provide a toner mother particle having a certain average particle diameter.

The obtained toner mother particle is added with the external additive for toner and further added with hydrophobic silica, if required, and mixed to provide a toner particle.

In an embodiment, the resin used as a raw material for the toner mother particle may be one kind of resin, for example, a polyester resin or a mixture of more than one kinds of resins. In addition, when two or more resin materials are mixed, two or more kinds of polyester resins different from each other are mixed and used. But, an embodiment is not limited thereto.

The colorant according to one embodiment may include a pigment for yellow, magenta, cyan color or a pigment such as carbon black or ferrosoferric oxide for black color, and other pigments and may be variously selected according to the usage of the toner.

In an embodiment, a charge control agent (CCA) is an additive controlling a polarity and an electrification of toner; as a positive electrified charge control agent, an azine-based compound, a quaternary ammonium salt and other positive charge control agents may be used; as a negative electrified charge control agent, an azo-based metal compound, a salicylic acid-based compound and other negative charge control agents; and it may be variously selected according the usage of toner.

In an embodiment, a release agent may include, for example, natural oil such as wax or synthesis oil such as silicone oil and may be variously selected according to the usage of toner.

In an embodiment, hydrophobic silica may be added in an appropriate amount to impart fluidity to the toner particle according to the kind of image forming apparatus in which a toner is used and may be a silica-based par tide having a small particle diameter of, for example, about 20 nm.

The external additive for a toner according to an embodiment may include a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product.

In an embodiment, the particulate has a number average particle diameter of about 50 nm to about 250 nm, a first specific surface area ($\alpha$) measured by a gas adsorption method of about 13 $m^2/g$ to about 80 $m^2/g$, and true density measured by a nominal volume expansion method of about 1.9 $g/cm^3$ to about 2.1 $g/cm^3$. In addition, when the particulate is formed into a film having a thickness 100 μm, a total light transmittance is greater than or equal to about 80% and a haze of less than or equal to about 10%.

The particulate according to such an embodiment has properties corresponding to Property (1) to Property (4) and particularly the following effects may exhibit by Property (4).

Because the particulate according to an embodiment has an average particle diameter within an appropriate range so as to provide a spacer effect, degradation of a toner may be suppressed when the particulate is attached to the surface of a toner particle.

Because the particulate according to an embodiment has a specific surface area within the ranges to have an appropriate quantity of electric charges, adhesion to a toner particle is improved. Because the particulate has improved mechanical strength, member damage or contamination by the particulate may be suppressed.

Because the particulate according to an embodiment minimizes an impact force to a toner particle when being externally added by satisfying the true density within the ranges, degradation of a toner may be suppressed.

According to an embodiment, because a ratio of a coarse particulate of the particulate is small, possibility of the particulate separating from the toner is low even under a severe environment of a high temperature/high humidity, and contaminations of photoreceptors, electrified rolls, or development rolls or cleaning blade defects may be suppressed.

Therefore, when the external additive for a toner including the particulate according to an embodiment is externally added to a toner, the toner is not degraded easily under a severe environment of a high temperature/high humidity and image defects by member contamination may be suppress.

An external additive for a toner according to an embodiment includes a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product, and has a number average particle diameter of about 50 nm to about 250 nm, true density measured by gas exchange method of about 1.90 $g/cm^3$ to about 2.10 g/cm$^3$, when the particulate is dispersed in a solution, a value obtained by dividing a specific gravity distribution of the particulate dispersed in the solution by the true density measured by a nominal volume expansion method is referred to as a specific weight distribution, and about 95% to about 100% of the specific weight distribution is referred to as a first specific weight region, about 90% to about 95% of the specific weight distribution is referred to as a second specific weight region is referred to as a second specific weight, the first specific weight region including about 0.5 wt % to about 9 wt % of the particulate and the second specific weight region including about 0.5 wt % to about 6 wt % of the particulate based on a total amount of the particulate dispersed in the solution.

The particulate according to such an embodiment has properties corresponding to Property (1), Property (3), and Property (8), and may have the following effect (v) by Property (8) in addition to Effects (i) to (iii).

(v) According to an embodiment, actually usable strength may be provided due to a specific weight distribution and a specific weight region by Property (8) and simultaneously an impact force to a toner particle when being externally added may be minimized and a distribution of a quantity of electric charge may be evenly controlled.

Through these, damages for the toner particle may be alleviated while durability or fluidity of the external additive are maintained, and particularly degradation of a toner or component contamination may be suppressed even under severe environments of a low temperature/low humidity and high temperature/high humidity environment for a long time.

Therefore, when an external additive for a toner including the particulate according to an embodiment is externally added to a toner, the toner is not degraded easily and image defects by component contamination may be suppressed even under severe environments of a low temperature/low humidity and high temperature/high humidity environment for a long time.

A process for producing an external additive for a toner according to an embodiment includes at least once performing processes of dissolving at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof in an organic solvent to obtain a silicon compound solution, mixing the silicon compound solution and a catalyst-containing component including a basic compound with a solution including water to obtain a mixed solution, and adding at least one of the silicon compound and the catalyst-containing component to the mixed solution and mixing them to obtain particulate dispersion liquid.

The silica particulate prepared by such a producing process may satisfy Properties (1) to (4) or one or more of Properties (5) to (7) in addition to Properties (1) to (4).

Therefore, by using the process for producing an external additive for a toner according to an embodiment, provided is an external additive for a toner where the particulate does not separate from the toner under a severe environment of a high temperature/high humidity, and contaminations of photoreceptors, electrified rolls, or development rolls or cleaning blade defects are suppressed.

According to an embodiment, a toner including the external additive for a toner is provided.

The toner includes the particulate having the properties and thus high degradation resistance under a severe environment of a high temperature/high humidity. In addition, the toner has a low possibility to generate coalesces on photoreceptors and may suppress image defects by member contamination under severe environments of a low temperature/low humidity and high temperature/high humidity environment for a long time.

Hereinafter, an external additive for a toner including the particulate according to an embodiment is specifically described with reference to Experimental Examples. However, each of Experimental Examples do not limit embodiments.

Hereinafter, when a definition is not otherwise provided, "parts" refers to "parts by weight".

Hereinafter, Example 1 will be subsequently described in the order of preparation of External Additive 1, property confirmation of the obtained External Additive 1, Preparation of Toner 1 using External Additive 1, and the characteristic evaluation of the obtained Toner 1.

Examples 2 to 12 and Comparative Examples 1 to 7 will be described in the same order as in Example 1.

Before describing Examples and Comparative Examples, measuring methods, durability tests, and evaluation methods applied to Examples and Comparative Examples are described.

<Measurement of Number Average Particle Diameter>

A particle diameter distribution of a particulate is obtained by dynamic light scattering using a device for measuring a dynamic light scattering particle distribution (ELSZ1000ZS, Otsuka Electronics) under the following measurement conditions, and an average particle diameter is referred to as a particulate diameter in which the number of accumulated particulates from a small number included in the particle diameter range divided based on the particle diameter distribution is reached to 50%. Detailed measurement methods are as follows.

First, a predetermined amount of a silica particulate is put in a methanol solvent followed by ultrasonication to obtain dispersion liquid including the silica particulate dispersed therein. Subsequently, the dispersion liquid is put in a measuring glass cell and the glass cell is put into a measuring device. Then, a dynamic light scattering intensity is measured by irradiating the measuring cell with a laser.

When a particle diameter distribution measured from changes of the measured dynamic light scattering intensity is illustrated in a second-dimension coordinate having a vertical axis of a number frequency and a cross axis of a particle diameter, an average particle diameter (Dn50) is referred to as a particulate diameter in which the number of accumulated particulates from a small number included in the particle diameter range divided based on the particle diameter distribution is reached to 50%.

<Measurement of First Specific Surface Area (a)>

A gas desorption time for a silica particulate as an external additive for a toner is measured using a BET flowing measurer of specific surface area (MODEL HM1201, manufactured by Mountech) and using the following BET (Brunauer-Emmett-Teller) method and a first specific surface area ($\alpha$) is calculated therefrom.

A measuring cell comprising a U-shaped object including a gas inlet and a gas outlet is used. 2 g of the silica particulate is put into the measuring cell. Then, a gas mixture of a nitrogen gas (adsorptive gas) and a helium gas (carrier gas) is flowed (nitrogen gas flow rate is 25 ml/min) into the measuring cell through the gas inlet, is contacted with the silica particulate, and then is discharged through the gas outlet.

Herein, while monitoring changes of relative pressure of a nitrogen gas, the measuring cell is cooled to a liquid nitrogen temperature so that the nitrogen gas may be adsorbed on the surface of the silica particulate powder (gas adsorption), and then, the measuring cell is returned to room temperature so that the nitrogen gas may be desorbed from the silica particulate powder (gas desorption).

Herein, a duration from the time when it becomes lower than an initial value of the adsorptive gas until it is returned to the initial value is referred to as a gas adsorption time and a duration from the time when it becomes higher than an initial value of the adsorptive gas until it is returned to the initial value is referred to as a gas desorption time.

A gas adsorption process depending on a time is illustrated as a graph based on the gas adsorption time and the gas desorption time and a first specific surface area (α) is calculated from an area of the graph.

<Measurement of True Density>

1.5 g of a particulate is put into a dry-auto density measurer (Aqupic II Series 1340, manufactured by Shimadzu). Subsequently, a volume and a mass of the particulate are measured, the mass relative to the volume of the particulate is calculated from the measurement values, and thereby true density (true specific gravity) of the particulate is calculated.

<Measurement of Specific Weight Distribution>

According to an embodiment, a reference of the specific weight distribution is defined using the true specific gravity.

First, a first aqueous solution having a reference specific gravity ($d_{1.001.00}$) based on a value ($d_{1.001.00}$) of a true specific gravity, a second aqueous solution having a specific gravity ($d_{0.95}$) that is 0.95 times the first aqueous solution, and a third aqueous solution having a specific gravity ($d_{0.90}$) that is 0.9 times the first aqueous solution, are prepared.

Then, 10 mL of the aqueous solutions having the predetermined specific gravity and a surfactant-containing aqueous solution mixed with a non-ionic surfactant (Contaminon® N) having a solid content of 0.5 wt % are added to 100 mg of a precisely weighed silica particulate to wet the silica particulate.

When the silica particulate is not wetted by the method, the following method is performed.

First, after 500 mg of acetone is added so as to wet the silica particulate, the surfactant-containing aqueous solution is added and uniformly mixed and the acetone is distilled and removed while maintaining an internal temperature at about 45° C.

Then, the mixture is ultrasonicated to promote dispersion of the silica particulate disperse and dispersion of primary particles is confirmed by a particle distribution measuring device (ELSZ1000ZS, manufactured by Otsuka Electronics) and SEM (SU8020, Hitachi, Ltd.). In addition, it is confirmed that agglomerates are not formed through SEM.

Then, centrifugation is performed at 20000 rpm for 30 minutes to perform a solid-liquid separation.

Then, a supernatant is removed through a decantation and washing with ion exchange water is performed three times.

Then, the sedimented silica particulate is dried using a freeze-drying method and a weight of the dried silica particulate is precisely weighed.

The processes are performed for each of three kinds of aqueous solutions having a different specific gravity.

In an embodiment, based on the fact that an external additive that is sedimented in each of three kinds of aqueous solutions has a specific gravity of greater than the corresponding aqueous solution, a specific gravity distribution is obtained as follows using a weight difference of an external additive that is sedimented in an aqueous solution having a closest specific gravity.

Then, a component ratio of the particulate in the first and second specific weight regions is calculated using weights of each particulate obtained through each of the three kinds of aqueous solutions. Herein, a total weight ($W_{tot}$) of the particulates in the aqueous solutions is set to be the same value for each of the three aqueous solutions.

An amount of the particulate included in the first specific weight region is calculated by dividing a difference ($W_{1.01.000}-W_{0.95}$) between a first weight ($W_{1.01.000}$) of the sedimented particulate measured using the first aqueous solution and a second weight ($W_{0.95}$) of the sedimented particulate measured using the second aqueous solution by the total weight ($W_{tot}$) of the particulate.

In the same way, an amount of the particulate included in the second specific weight region is calculated by dividing a difference ($W_{0.95}-W_{0.90}$) between a second weight ($W_{0.95}$) of the sedimented particulate measured using the second aqueous solution and a third weight ($W_{0.90}$) of the sedimented particulate measured using the third aqueous solution by the total weight ($W_{tot}$) of the particulate.

<Calculation of Ratio (α/β) of First Specific Surface Area Relative to Second Specific Surface Area>

A second specific surface area (β) is calculated from Equation 1 using the average particle diameter (Dn50) measured by the BET method and the true density (ρ). The calculated second specific surface area (β) is divided by the first specific surface area (α) measured by the BET method to calculate a ratio (α/β) of the first specific surface area relative to the second specific surface area.

<Measurement of Total Light Transmittance and Haze>

1.2 g of a hydrophobic silica particulate powder is put into a sample tube, 1.8 g of methylisobutylketone is added thereto, ultrasonicated for 30 minutes, and silica dispersion liquid having a solid content of 40 wt % is prepared.

Then, the silica dispersion is coated on a glass substrate using an applicator (gap width: 250 μm), and dried at about 80° C. for about 15 minutes to form a film of the silica particulate having a film thickness of 100 μm.

The film thickness is measured using a constant pressure thickness measurer (TECLOCK) that is a probe film thickness measurer.

The total light transmittance and haze of the formed film are measured using a haze meter (NDH 5000W, Suga Test Instrument Co., Ltd.). A light source of the haze meter is D65 and light having a wavelength region of about 380 nm to about 780 nm is mainly used.

<Measurement of Coarse Particulate Using Scanning Electron Microscope>

A hydrophobic silica particulate powder is uniformly attached on a carbon tape so that the tape surface may not be exposed and examined at 10000 magnification of scanning electron microscope (SU8020, Hitachi, Ltd.).

When a presence ratio of an agglomerate having a particle diameter of greater than or equal to about 1 μm of an examination view at once examination is referred to as Er (unit: %) and an area of an agglomerate having a particle diameter of greater than or equal to about 1 μm is referred to as S1 and a visual area at examination is referred to as S2, S1 and S2 are substituted in Equation 2 to calculate Er. In an embodiment, S2 is set to be 110 pmt.

$$Er=(S1/S2)\times 100 \quad \text{[Equation 2]}$$

Because the agglomerate does not generally have a specific shape, a circumscribed circle of the agglomerate is set using a regard-area method and thereby, the area S1 of the agglomerate is obtained.

More specifically, after a circumscribed circle is predetermined for each of agglomerates examined by a scanning electron microscope, and circumscribed circles having a diameter of greater than or equal to about 1 μm of the predetermined circumscribed circles are extracted, areas of the extracted circumscribed circles are added to obtain S1. In an embodiment, the examinations for randomly selected different points are performed ten times in total and simple averages thereof are obtained and set to be a presence ratio of the agglomerate.

<Measurement of Degree of Methanol Hydrophobization>

50 ml of ion exchange water and 0.2 g of a hydrophobic silica particulate powder are put in a beaker, dispersion liquid including the hydrophobic silica particulate powder dispersed therein in the beaker is stirred using a magnetic stirrer, and methanol is dripped thereto through a burette.

As a methanol concentration is increased in the beaker, a particulate powder is sedimented slowly. In an embodiment, at the time when all the particulate powders are precipitated, a volume fraction of methanol in dispersion liquid-methanol mixed solution is measured and the measured value is set to be a hydrophobization degree (volume %) of the hydrophobic silica particulate powder.

<Measurement of Loss on Heating>

A silica particulate is put into an aluminum container and is heasted at a rate of 3° C./min from room temperature until 500° C. according to thermogravimetry/differential thermal simultaneous analysis (TGDTA) using a thermogravimetry/differential thermal simultaneous measuring device (TG/DTA6200, Seiko Instrument).

The weight of an aluminum container is weighed by a balance in the measuring device during the heating. After completing the heating, the difference between after the heating and before the heating is compared to obtain the loss on heating (unit: wt %).

<Electrification Evaluation>

1.4 parts of the toner particle obtained in Toner Preparation Example 1 that will be described later and 18.6 parts of a ferrite particle (volume average particle diameter: 35 μm) coated with a resin consisting of a styrene-methylmethacrylate copolymer are weighed, are put in 50 ml of a polypropylene (PP) container, and are allowed to stand for 24 hours under each of a low temperature/low humidity (L/L) environment (15° C./10% RH) and a high temperature/high humidity (H/H) environment (32° C./80% RH).

Then, the resultant is stirred using a tumbler mixer for 30 minutes, and thereby a load to generate a friction charge is imparted by colliding the toner with the ferrite particle.

A quantity of electric charge (unit: μC/g) of the particulate is measured by ratio equation-based measuring device of a quantity of electric charge (electric field ratio equation-based measuring device of a quantity of electric charge, II-DCelectric field, DIT Co., Ltd.), and each of a quantity of electric charge under a UL environment and a H/H environment and a ratio (H/L ratio) of a quantity of electric charge under a H/H environment relative to a quantity of electric charge under a UL environment are measured.

When the H/L ratio is greater than or equal to about 0.4, it has no problem for actually using, but greater than or equal to about 0.5 may be desirable.

On the other hand, a volume average particle diameter of the ferrite particle measured by using a particle diameter distribution measuring device (multi-seizer, manufactured by Beckman Coulter).

<Evaluation of Toner Agglomeration Degree>

100 ml of a toner is put in a polypropylene (PP) jar, and is allowed to stand under a room temperature/normal humidity environment of 23° C./50% RH for 24 hours.

Subsequently, sieves of 53 μm, 45 μm, and 38 μm are sequentially disposed in series using a powder tester (Hosokawa Micron Corp.) and 2 g of a toner sample is put on the sieve of 53 μm.

Then, sieving is performed by imparting a vibration with an amplitude of 1 mm for 90 seconds, and weights of remaining toners on each sieve are weighed, weights of remaining powders on each sieve are multiplied by 0.5, 0.3, and 0.1 weights in an order of sieves of 53 μm, 45 μm, and 38 μm, and the obtained values are multiplied by 100 to set an agglomeration degree.

<Evaluation of Heat-Resistance Storage>

7 parts of the toner particle obtained in Toner Preparation Example 1 that will be described later and 93 parts of a ferrite particle (volume average particle diameter: 35 μm) coated with a resin consisting of a styrene-methylmethacrylate copolymer are weighed, are put in 250 ml polypropylene (PP) container, and are allowed to stand for 24 hours under a high temperature high humidity (H/H) environment (32° C./80% RH).

Then, the resultant is stirred using a tumbler mixer for 30 minutes, and a ferrite particle is removed using a magnetic field, and an agglomeration degree of the toner is measured to set the value to be (a). Remaining toners are put in a 3 cm×3 cm box and are allowed to stand for 24 hours under a 50° C./50% RH environment while a load of 80 g/cm$^2$ is applied, and thereby a sample is obtained. The agglomeration degree of the obtained sample is measured to set the value to be (b), (a)/(b) is calculated, and is evaluated as follows.

A: (a)/(b) is greater than or equal to about 0.8

B: (a)/(b) is greater than or equal to about 0.7 and less than about 0.8

C: (a)/(b) is greater than or equal to about 0.6 and less than about 0.7

D: (a)/(b) is less than about 0.6

When (a)/(b) is greater than or equal to about 0.7, that is evaluation is greater than or equal to B, it has no problem for actually using, but greater than or equal to about 0.8 may be desirable.

<Durability Test 1>

Durability Test 1 is performed using an actual printer as follows.

A color laser printer (CLP-610ND, Samsung Electronics Co., Ltd., (print speed: 21 sheets/min) having a one-component development manner is used as an image forming apparatus.

A toner is put in a black image forming unit of the image forming apparatus, a full-color copy machine paper (Fuji Xerox Co., Ltd., (82 g/cm$^2$, A4 size)) for a transfer material is used, and tests are carried out under each of a low temperature/low humidity (UL) environment (15° C./10% RH), a room temperature/normal humidity (N/N) environment (23° C./55% RH), and a high temperature/high humidity (H/H) environment (32° C./80% RH).

Herein, a text image where a factor ratio is controlled to be 5% and Durability Test 1 is performed based on a reference of printing 1500 sheets in total under a condition of interrupt of 1 minute at each time of printing two sheets in a single color mode.

Then, Evaluations (1. image concentration, 2. fogging, 3. halftone fading, 4. filming resistance, 5. fine line reproducibility) are performed.

<Durability Test 2>

Durability Test 2 is performed in the same method as Durability Test 1 except that is performed based on a reference of printing 5000 sheets in total under a condition of interrupt of 1 minute at each time of printing two sheets in a single color mode. Then, Evaluations (1. image concentration, 2. fogging, 5. fine line reproducibility) are performed using the same apparatus. In addition, Evaluation (6. member contamination) under a low temperature/low humidity (UL) environment (15° C./10% RH) is performed.

<Durability Test 3>

Durability Test 3 is performed in the same method as Durability Test 1 except that a factor image is replaced by a beta black image having a central portion of a 10 cm width, a factor environment is two kinds of environments of a high temperature/high humidity (H/H) environment (32° C./80% RH) and a low temperature/low humidity (UL) environment (15° C./10% RH), and an output manner is changed into a continuous printing manner. Then, Evaluation (4. filming resistance) is performed using the same apparatus.

<Evaluation>

The following evaluations may be performed under the same atmosphere as in the corresponding durability test if there is the durability test corresponding to each evaluation.

Meanwhile, even if the evaluation is performed without the durability test, it may be performed under the same atmosphere as in the durability test.

<1. Image Concentration>

As the evaluation for the early use stage, one sheet of image including each of square solid patches (each side length: 5 mm) on four corners and a center portion is printed using the evaluation subject toner, without performing the Durability Test. Then light is irradiated to the printed image, and the reflection concentration of patch is measured from the reflectance of reflected light using a colorimeter (manufactured by GretagMacbeth), and the average of measured values is evaluated according to following criteria and classified as falling under A to D.

Durability Test 1 or Durability Test 2 is performed using the same toner, and then evaluations such as 'initial evaluations' may be performed. Unlike the initial evaluations, evaluation after durability tests is referred to as 'evaluation after durability test'.

'Evaluation after durability test" is performed using the toner after the durability tests.

When the toner has a high quantity of electric charge, toner hardly escapes from the developing member in the development step, so the toner amount developed on the photoreceptor may be reduced.

Thus, when the image concentration is low, the toner may have a high quantity of electric charge.

A to D are as follows.

A: average of reflection concentration-measured values is greater than or equal to about 1.20 (appropriately usable).

B: average of reflection concentration measured values is greater than or equal to about 1.05 and less than about 1.20 (usable).

C: average of reflection concentration measured values is greater than or equal to about 0.90 and less than about 1.05 (difficult to use).

D: average of reflection concentration measured values is less than about 0.90 (unusable).

<2. Fogging>

As for the initial evaluation, one sheet of image including both the white background region and the printed region is printed using the same toner as in above without performing Durability Test 1 and Durability Test 2. The printed image is measured using a colorimeter (reflectometer, manufactured by Tokyo Denshoku), and the fogging concentration (%) is calculated from the difference between the whiteness degree of the white background region of the image and the whiteness degree of the transfer paper, the image fogging is evaluated according to the following criteria and classified as falling under A to D.

Using the same toner as above, evaluation of 'after durability test' is performed.

The fogging means phenomenon that the toner is not transferred on the latent image of photoreceptor and transferred to the white background region where is no-image region at the developing stage, when toner is not electrified, or the quantity of electric charge of toner is low, or the toner is electrified in the opposite polarity, so as to deteriorate the image quality. Accordingly, the high fogging concentration means the cases that the toner is not electrified or electrified in an opposite polarity or that the toner has a low quantity of electric charge.

A to D are as follows.

A: fogging concentration is less than or equal to about 1.0% (appropriately usable).

B: fogging concentration is greater than or equal to about 1.0% and less than about 2.0% (usable).

C: fogging concentration is greater than or equal to about 2.0% and less than about 3.0% (difficult to use).

D: fogging concentration is greater than or equal to about 3.0% (unusable).

<3. Halftone Fading>

After Durability Test 1, halftone image having 25% image concentration is printed using the toner. The printed image is observed by naked eyes whether the halftone is faded and disappeared, and it is evaluated by the following criteria and classified as falling under A to D.

Halftone fading is a phenomenon that a part of image concentration is dramatically faded away on the paper where image is to be formed by toner due to the electrification defects of toner generated when the external additive for toner has a high hygroscopicity, thereby, it may determine whether image is defective or not. Thereby, when the halftone fading occurs, it is understood that the toner electrification is defective.

A to D are as follows.

A: Halftone fading does not occur at any one of three atmospheres (room temperature/room humidity, low temperature/low humidity and high temperature/high humidity), (appropriately usable).

B: Halftone fading occurs at one of three atmospheres (room temperature/room humidity, low temperature/low humidity and high temperature/high humidity), but the degree of halftone fading is not serious, so it is not difficult to be practically used (usable).

C: Halftone fading occurs at one of three atmospheres (room temperature/room humidity, low temperature/low humidity and high temperature/high humidity), and the halftone fading is obvious, so it causes problem of being practically used (difficult to use).

D: Halftone fading occurs at all three atmospheres (room temperature/room humidity, low temperature/low humidity and high temperature/high humidity), (unusable).

<4. Filming Resistance>

After Durability Test 1 or Durability Test 3, one sheet of a halftone image is printed using the toner and printed image and photoreceptor surfaces are examined.

On observing the photoreceptor surface, the toner on the surface of photoreceptor is removed by the air blow.

Whether the image is defective or not and whether the surface of photoreceptor is fused with the external additive to be filmed are observed by naked eye and evaluated according to the following criteria and classified as falling under A to D.

The filming means phenomenon in which the external additive separated by the physical force is attached on the surface of photoreceptor and then thermally fused with the photoreceptor to be filmed, when the adhesion between the toner particle and the external additive is deteriorated due to the low quantity of electric charge of toner. The filming may easily occur under high temperature/high humidity environment.

In addition, whether the image is defective may be determined by observing whether the halftone is faded in the halftone image or whether there is any region where the halftone is darkly printed.

A to D are as follows.

A: no filming on the surface of photoreceptor, and the image is never defective.

B: slight filming on the surface of photoreceptor, but the image is never defective.

C: filming on the surface of photoreceptor, and the image is slightly defective.

D: obvious filming on the surface of photoreceptor, and the image is obviously defective (unusable).

<5. Fine Line Reproducibility>

Without performing Durability Test 2 as for the initial evaluation, fine line images having a line width of 150 μm are formed on a photoreceptor and fixed thereon.

The fine line images are examined with a 50× magnifying glass and are classified as falling under A to D.

Using the same toner as above, evaluation of 'after durability test' is performed.

A to D are as follows.

A: fine lines are filled with the toner uniformly and distortion of an edge is not examined.

B: fine lines are filled with the toner uniformly but a little distortion of an edge is examined.

C: fine lines are filled with the toner uniformly but remarkable distortion of an edge is examined.

D: fine lines are not filled with the toner uniformly and remarkable distortion of an edge is examined.

<6. Component Contamination>

Component contamination refers to contaminating each surface of development rolls, electrification rolls, and other components. Particularly, contaminating the surface of the development rolls is generated by low adhesion properties between the external additive and toner particles and separation of the external additive particulate from the toner particle.

After Durability Test 2, each one sheet of a black image, a white image, and a halftone image are sequentially printed using the toner and printed images and the surface of the development rolls are examined.

On observing the development roll, the toner on the surface is removed by air blowing.

Whether the image is defective or not and how contaminated the development roll, is evaluated according to the following criteria and classified as falling under A to D.

A to D are as follows.

A: the surface of development roll is never contaminated, and the image is never defective.

B: the surface of development roll is little contaminated, and the image is never defective.

C: the surface of development roll is contaminated, and the image is little defective.

D: the surface of development roll is obviously contaminated, and the image is obviously defective (unusable).

In addition, 'evaluation after durability test' is performed using the toner.

According to the criteria of Evaluation 1 to Evaluation 6, 'A' evaluation refers to appropriately usable and 'B' evaluation refers to sufficiently usable.

C is usable if only one C is evaluated besides A or B, but it is unusable if two or more C's are evaluated. Meanwhile, if there is any one D evaluation, it is classified as unusable.

Evaluation of a filming resistance according to an embodiment is not performed under a room temperature/normal humidity environment. This is because the filming is easily generated under severe environments of a high temperature/high humidity or a low temperature/low humidity particularly and if it is not generated under the severe environments, it has a very low possibility that the filming is generated under a room temperature/normal humidity condition.

Evaluation of component contamination according to an embodiment is performed under only low temperature/low humidity environment. This is because image degradation by component contamination is easily generated under low temperature/low humidity environment and if component contamination is not generated under a low temperature/low humidity environment, it has a very low possibility that component contamination is generated under other conditions.

In addition, the filming and member contamination are caused during a use of a toner and thus evaluations after durability tests are performed without the initial evaluation.

External additives for a toner according to Example 1 to Example 7 prepared by the process for producing an external additive for a toner (1) and toners including the same are as follows.

Example 1

<Preparation of External Additive 1>

First, an external additive 1 for a toner (External Additive 1) according to Example 1 is prepared.

<1. Preparation Process of Particulate Dispersion Liquid>

400 parts of ethanol is put in a reaction vessel equipped with a reflux pipe, 40 parts of tetraethoxysilane (TEOS) (0.1 (g/g) based on the entire weight of an organic solvent) is added thereto, while the ethanol stirred at 35° C. and 150 rpm, and then, the obtained mixture is stirred for 30 minutes.

Then, a mixture of 100 parts of distilled water and 8 parts of a 40% methylamine aqueous solution 8 is set at 35° C. and added thereto.

The reaction solution is stirred at 35° C. for 1 hour, 40 parts of tetraethoxysilane set at 35° C. is added thereto, the mixture is stirred for 10 minutes, and a mixture of 100 parts of distilled water and 8 parts of a 40% methylamine aqueous solution set at 35° C. is added thereto.

In addition, the reaction solution is stirred at 35° C. for 1 hour, 40 parts of tetraethoxysilane set at 35° C. is added thereto, the mixture is stirred for 10 minutes, and a mixture of 100 parts of distilled water and 8 parts of a 40% methylamine aqueous solution set at 35° C. is added thereto.

Subsequently, the obtained mixture is stirred for 5 hours at 35° C. to obtain a silica sol having a solid content of 3.98%.

The silica sol is solid-liquid separated using a centrifugal sedimentation method, and after removing a supernatant therefrom through decantation, 200 parts of distilled water is added thereto to obtain an aqueous dispersion sol of silica particulates.

<2. Particulate Hydrophobizing Process>

The aqueous dispersion sol is heated and stirred at 90° C. for 3 hours to hydrophobize the aqueous dispersion sol on the surface and simultaneously remove a basic compound. Subsequently, liquid is separated from the resulting product using the centrifugal sedimentation method (process referred to herein a solid-liquid separation), 200 parts of distilled water is added thereto. The processes of adding water and solid-liquid separation are repeated three times. Then, a precipitate therein is lyophilized for 24 hours to obtain a white powder.

Then, 170 parts of distilled water is added to 30 parts of the white powder, and the mixture is stirred at 100° C. for 7 hours to rehydrophobize the surface of the white powder.

After decreasing the temperature down to room temperature, 30 parts of hexamethyldisilazane (HMDS) is added to the resultant, and the mixture is stirred at 100° C. for 5 hours.

The resultant is solid-liquid separated, and the obtained powder is dried for 24 hours under a reduced pressure to obtain white powder-phased silica particulates. During the process, $(T1\times t1)+(T2\times t2)$ is 970° C.·hr.

A type, an amount of a raw material for External Additive 1 and a preparation condition and other parameters for External Additive 1 are shown in Table 1.

<Properties of External Additive 1>

The external additive 1 has a number average particle diameter (Dn50) of 123 nm, a first specific surface area ($\alpha$) of 23 $m^2/g$, true density of 2.01 $g/cm^3$, total light transmittance of 84%, a haze of 5.3%, a coarse particulate ratio of 1.0%, $\alpha/\beta$ of 0.9, and a hydrophobization degree of 65% and satisfies Properties (1) to (7) of the particulate referring to the evaluation.

The evaluation results of External Additive 1 are shown in Table 2.

Hereinafter, a toner mother particle to which the external additive is added is manufactured as follows.

<Preparation of Resin 1>

A resin 1 as a raw material for producing the toner mother particle is prepared as follows. The resin 1 is prepared by putting 10800 g of a propyleneoxide addition product of bisphenol A (the number of average addition mol: 2.2 mols), 4300 g of an ethyleneoxide addition product of the product bisphenol A (number of average addition mol: 2.0 mols), 5040 g of terephthalic acid, and 700 g of n-dodecenyl succinic anhydride in a reaction vessel equipped with a Dean-Stark trap), stirring the mixture under a nitrogen atmosphere at 230° C., adding 2112 g of trimellitic anhydride thereto after finding out when water produced by a reaction is not leaked by examining when the amount of water gathered in the trap is not increased, and reacting them until a softening point reaches 147° C. The resin 1 is called Polyester A.

When measured after the reaction, Polyester A has a softening point of 145° C., a glass transition point of 73° C., a maximum peak temperature of heat fusion of 80° C., an acid value of 26 mgKOH/g, and a hydroxyl value of 27 mgKOH/g.

<Preparation of Resin 2>

A resin 2 used as a raw material for a toner mother particle is manufactured as follows. The resin 2 is prepared by putting 12250 g of a propyleneoxide addition product of bisphenol A (the number of average addition mol: 2.2 mols), 21125 g of an ethyleneoxide addition product of the bisphenol A (the number of average addition mol: 2.0 mols), 14940 g of terephthalic acid, and 15 g of dibutyltin oxide in a reaction vessel, stirring them under a nitrogen atmosphere at 230° C., and reacting them until a softening point reaches 121° C.

The resin 2 is called to be Polyester B.

When measured after the reaction, Polyester B has a softening point of 120° C., a glass transition point of 65° C., a maximum peak temperature of heat tusion of 70° C., an acid value of 36 mgKOH/g, and a hydroxyl value of 23.7 mgKOH/g.

<Preparation of Toner Mother Particle 1>

A toner mother particle 1 is prepared by using a resin 1 (Polyester A) and a resin 2 (Polyester B) as follows.

2880 g of the polyester A, 4320 g of the polyester B, 300 g of pigment blue 15:3 (Dainichiseika Color & Chem MFG Co., Ltd.) as a colorant, 86.5 g of a charge control agent (LR-147, Japan Carlit Co., Ltd.), and 504 g of carnauba wax (a melting point: 83° C., S. Kato & Co.) as a hydroxyl acid ester-containing release agent in a Henschel mixer and stirring the mixture at 3000 rpm for 15 minutes. The mixture is melt-kneaded with an open roll continuous kneading machine to obtain a kneaded product. The open roll continuous kneading machine has a roll having an exterior diameter of 0.14 m and an effective length of 0.8 m and is operated by setting a rotation speed at 33 m/min as for a heated roll (before roll) and at 11 m/min as for a cooled roll (after roll) and having a roll gap of 0.1 mm. As for a temperature of heating and cooling medium in a roll, the heated roll is set at 150° C. where a raw material is injected and at 115° C. where the kneaded product is discharged, while the cooled roll is set at 35° C. where the raw material is injected and at 30° C. where the kneaded product is discharged.

The knead product is coarsely crushed with a rotor breaker and then, pulverized and distributed with a rotating disk pulverizer (IDS-2 series, Nippon Pneumatic Kogkyo) and a dispersion separator to obtain a toner particle having a volume average particle diameter of about 8.0 μm (a toner mother particle 1).

<Preparation of Toner 1>

Toner 1 may be prepared by adding 1.0 part of hydrophobic silica (TS720: Carbot Corp.) and 0.4 parts of External Additive 1 to 50 parts of the toner mother particle 1 and mixing them at 10,000 rpm for 30 minutes with a sample mill.

<Evaluation of Toner 1>

Evaluations 1 to 4 regarding characteristics of the toner 1 are performed, and the results are shown in Table 3.

As shown in Table 3, the toner 1 shows satisfactory H/L and is evaluated as B in the item 2 of fogging and halftone fading 2 after Durability Test 1 under a low temperature/low humidity environment but all A's in all the other items out of the entire 10 items.

Considering that greater than or equal to B in the evaluations guarantees a practical use of a toner, the toner 1 may have excellent degradation resistance and other properties even when used under a severe condition ranging from a low temperature/low humidity to a high temperature/high humidity as well as room temperature/normal humidity and provide a print with high quality.

This result may be caused by properties of External Additive 1 added to the toner 1.

Example 2

<Preparation of External Additive 2>

External Additive 2 is obtained through the same process as the process of producing External Additive 1 except for changing the preparation process of particulate dispersion liquid as follows.

400 parts of ethanol is put in the same reaction vessel as used in Example 1, and 60 parts of tetraethoxysilane (TEOS) is added thereto, while the ethanol is stirred at 35° C. and 150 rpm, and the mixture is stirred for 30 minutes.

Then, a mixture of 300 parts of distilled water and 24 parts of a 40% methylamine aqueous solution is set at 35° C. and added thereto.

After stirring the reaction solution at 35° C. for 1 hour, 60 parts of tetraethoxysilane set at 35° C. is added thereto, and the obtained mixture is stirred for 5 hours at 35° C. to obtain a silica sol having a solid content of 3.98%.

A kind and an amount of a raw material for External Additive 2 and a preparation condition of External Additive 2 are shown in Table 1.

<Properties of External Additive 2>

External Additive 2 has a number average particle diameter (Dn50) of 198 nm, a first specific surface area (α) of 15 $m^2/g$, true density of 2.03 $g/cm^3$, total light transmittance of 80%, a haze of 9.4%, a coarse particulate ratio of 2.8%, α/β of 1.0, and a hydrophobization degree of 63% and satisfies Properties (1) to (7) of the particulate.

The property evaluation results of External Additive 2 are shown in Table 2.

Example 3

<Preparation of External Additive 3>

External Additive 3 is obtained according to the same process as the process of preparing External Additive 1 except for changing the preparation process of particulate dispersion liquid as follows.

400 parts of ethanol is put in a reaction vessel equipped with a reflux pipe, 20 parts of tetraethoxysilane (TEOS) (0.05 (g/g) based on the entire weight of an organic solvent) is added thereto, while the ethanol is stirred at 35° C. and 150 rpm, and the obtained mixture is stirred for 30 minutes.

Then, a mixture of 50 parts of distilled water and 4 parts of a 40% methylamine aqueous solution is set at 35° C. and added thereto.

After stirring the reaction solution at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution set at 35° C. is added thereto.

In addition, after stirring the reaction solution at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution at 35° C. is added thereto.

Next, after stirring the reaction solution at 35° C. for 1 hour, 20 parts of tetraethoxysilane set at 35° C. is added thereto, the obtained mixture is stirred for 10 minutes, and a mixture of 50 parts of distilled water and 4 part by weight of a 40% methylamine aqueous solution set at 35° C. is added thereto.

Further, after stirring the reaction solution at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution set at 35° C. is added thereto.

Furthermore, after stirring the reaction solution at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution set at 35° C. is added thereto.

In other words, a process of adding 20 parts of tetraethoxysilane and 10 minutes later, a mixture of 50 parts of distilled water and 4 parts of a 40% methylamine aqueous solution is 6 times repeated.

Then, the resulting mixture is stirred for 5 hours at 35° C. to obtain a silica sol having a solid content of 3.98%.

The obtained silica sol Is solid-liquid separated through a centrifugal sedimentation, and after removing a supernatant therefrom through decantation, 200 parts of distilled water is added thereto to obtain an aqueous dispersion sol of silica particulates.

A type and an amount of a raw material and a preparation condition of External Additive 3 are shown in Table 1.

<Properties of External Additive 3>

External Additive 3 has a number average particle diameter (Dn50) of 93 nm, a first specific surface area (α) of 21 $m^2/g$, true density of 1.98 $g/cm^3$, total light transmittance of 85%, a haze of 2.9%, a coarse particulate ratio of 0.2%, α/β of 0.6, and a hydrophobization degree of 67% and satisfies Properties (1) to (7) of the particulate.

The property evaluation results of External Additive 3 are shown in Table 2.

Example 4

<Preparation of External Additive 4>

External Additive 4 is obtained through the same process as the process of producing External Additive 1 except for changing the producing process as follows.

Preparation Process of Particulate Dispersion Liquid

A preparation process of a particulate dispersion liquid according to Example 4 is as follows.

400 parts of ethanol is put in a reaction vessel equipped with a reflux pipe, 60 parts of tetraethoxysilane (TEOS) (0.15 (g/g) based on the entire weight of an organic solvent) is added thereto while the ethanol is stirred at 35° C. and 150 rpm, and the obtained mixture is stirred for 30 minutes.

Then, a mixture of 50 parts of distilled water and 4 parts of a 40% methylamine aqueous solution is set at 35° C. and added thereto.

The reaction solution is stirred at 35° C. for 1 hour, 20 parts of tetraethoxysilane set at 35° C. is further added thereto, the mixture is stirred for 10 minutes, and a mixture of 50 parts of distilled water and 4 parts of a 40% methylamine aqueous solution set at 35° C. is added thereto.

Next, after stirring the reaction solution at 35° C. for 1 hour, 20 parts of tetraethoxysilane set at 35° C. is further added thereto, the obtained mixture is stirred for 10 minutes, and a mixture of 50 parts of distilled water and 4 parts of a 40% methylamine aqueous solution set at 35° C. is mixed added thereto.

In addition, after stirring the reaction solution at 35° C. for 1 hour, 60 parts of tetraethoxysilane set at 35° C. is added thereto, the obtained mixture is stirred for 10 minutes, and a mixture of 50 parts of distilled water and 4 parts of a 40% methylamine aqueous solution are added thereto.

Further, the reaction solution is stirred at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution set at 35° C. is added thereto.

Furthermore, the reaction solution is stirred at 35° C. for 1 hour, 20 parts of tetraethoxysilane set at 35° C. is added thereto, the obtained mixture is stirred for 10 minutes, and a mixture of 50 parts of distilled water and 4 parts of a 40% methylamine aqueous solution set at 35° C. is added thereto.

Then, the obtained mixture is stirred at 35° C. for 5 hours to obtain a silica sol having a solid content of 3.98%.

The obtained silica sol is solid-liquid separated in a centrifugal sedimentation method, and after removing a supernatant through decantation, 200 parts of distilled water is added thereto to obtain an aqueous dispersion sol of silica particulates.

(2) Particulate-Hydrophobizing Process

The particulate hydrophobizing processes according to Examples 1 to 4 have the following difference.

The heat treatment temperature (T2) of the fifth process is changed from 100° C. to 118° C., and the (T1×t1)+(T2×t2) is changed from 970° C.·hr to 1096° C.·hr.

The solvent used in the fifth process is changed from water to methylisobutylketone.

A type and an amount of a raw material for External Additive 4 and a preparation condition for External Additive 4 are shown in Table 1.

<Property Evaluation of External Additive 4>

External Additive 4 has a number average particle diameter (Dn50) of 80 nm, a first specific surface area (α) of 18 $m^2/g$, true density of 1.94 $g/cm^3$, total light transmittance of 83%, a haze of 8.8%, a coarse particulate ratio of 0.6%, α/β of 0.5, and a hydrophobization degree of 58% and satisfies Properties (1) to (7) of the particulate.

The property evaluation results of External Additive 4 are shown in Table 2.

Example 5

<Preparation of External Additive 5>

A process for producing External Additive 5 is based on the process according to Example 4, but the preparation process of a particulate dispersion liquid is changed as follows. Herein, a particulate hydrophobizing process is the same as the process for producing External Additive 4.

Hereinafter, the preparation process of a particulate dispersion liquid for External Additive 5 is illustrated.

400 parts of ethanol is put in a reaction vessel equipped with a reflux pipe, 20 parts of tetraethoxysilane (TEOS) (0.05 (g/g) based on the entire weight of an organic solvent) is added thereto, while the ethanol is stirred at 35° C. and 150 rpm, and the obtained mixture is stirred for 30 minutes.

Then, a mixture of 150 parts of distilled water and 12 parts of a 40% methylamine aqueous solution is set at 35° C. and added thereto.

After stirring the reaction solution at 35° C. for 1 hour, 20 parts of tetraethoxysilane set at 35° C. is added thereto, the obtained mixture is stirred for 10 minutes, 20 parts of tetraethoxysilane set at 35° C. is further added thereto, and the obtained mixture is stirred for one hour more.

Then, 20 parts of tetraethoxysilane set at 35° C. is added thereto, the obtained mixture is stirred for 10 minutes, and a mixture of 150 parts of distilled water and 12 parts of a 40% methylamine aqueous solution set at 35° C. is added thereto.

In addition, the reaction solution is stirred at 35° C. for 1 hour, 20 parts of tetraethoxysilane set at 35° C. is further added thereto, the obtained mixture is stirred at 35° C. for 1 hour, and then, 20 parts of tetraethoxysilane set at 35° C. is added thereto.

Subsequently, the obtained mixture is stirred at 35° C. for 5 hours to obtain a silica sol having a solid content of 3.98%.

The silica sol is solid-liquid separated in a centrifugal sedimentation method, and after removing a supernatant through decantation, 200 parts of distilled water is added thereto to obtain an aqueous dispersion sol of silica particulates.

A kind and an amount of a raw material for External Additive 5 and a preparation condition of External Additive 5 are shown in Table 1.

<Property Evaluation of External Additive 5>

External Additive 5 has a number average particle diameter (Dn50) of 61 nm, a first specific surface area (α) of 38 $m^2/g$, true density of 2.00 $g/cm^3$, total light transmittance of 86%, a haze of 4.1%, a coarse particulate ratio of 0.1%, α/β of 0.8, and a hydrophobization degree of 62% and satisfies Properties (1) to (7) of the particulate.

Property evaluation results of the External Additive 5 are shown in Table 2.

Example 6

<Preparation of External Additive 6>

An external additive 6 is obtained according to the same process as the process of producing External Additive 3 except for the following particulate hydrophobizing process.

The heat treatment temperature T1 of the fourth process is decreased down from 90° C. to 60° C.

Heat treatment time t1 in the fourth process is changed from 3 hours to 8 hours.

The fifth process is omitted.

As a result, (T1×t1)+(T2×t2) is changed from 970° C.·hr to 480° C.·hr.

A type and an amount of a raw material for External Additive 6 and a preparation condition of External Additive 6 are shown in Table 1.

<Property Examination of External Additive 6>

External Additive 6 has a number average particle diameter (Dn50) of 98 nm, a first specific surface area (α) of 26 $m^2/g$, true density of 1.94 $g/cm^3$, total light transmittance of 88%, a haze of 2.6%, a coarse particulate ratio of 0.2%, α/β of 0.8, and a hydrophobization degree of 38% and satisfies Properties (1) to (7) of the particulate.

The property evaluation results of External Additive 6 are shown in Table 2.

Example 7

<Preparation of External Additive 7>

External Additive 7 is obtained according to the same process as the process of producing External Additive 3 except for the following particulate hydrophobizing process.

The heat treatment temperature T1 in the fourth process is increased from 90° C. to 100° C.

Heat treatment time t1 in the fourth process is changed from 3 hours to 8 hours.

(C) The heat treatment temperature T2 in the fifth process is increased form 100° C. to 150° C.

(C) Heat treatment time t2 in the fifth process is changed from 7 hours to 12 hours.

As a result, (T1×t1)+(T2×t2) is changed from 970° C.·hr to 2600° C.·hr.

(D) The solvent used in the fifth process is changed from water to isobutylketone.

A type and an amount of a raw material for External Additive 7 and a preparation condition of External Additive 7 are shown in Table 1.

<Property Evaluation of External Additive 7>

External Additive 7 has a number average particle diameter (Dn50) of 95 nm, a first specific surface area (α) of 16 $m^2/g$, true density of 1.94 $g/cm^3$, total light transmittance of 83%, a haze of 5.8%, a coarse particulate ratio of 1.1%, α/β of 0.5, and a hydrophobization degree of 72% and satisfies Properties (1) to (7) of the particulate.

Property evaluation results of External Additive 7 are shown in Table 2.

<Preparation of Toners 2 to 7>

Toners 2 to 7 are obtained according to the same method as the method of producing the toner 1 except for respectively using External Additives 2 to 7 instead of External Additive 1.

<Evaluation of Toners 2 to 7>

The same evaluation as performed for the toner 1 is performed about Toners 2 to 7, and the results are shown in Table 3.

As shown in Table 3, the evaluation of Toners 2 to 7 is as follows.

Toner 2 shows satisfactory H/L and is evaluated as B in an image concentration but A in the rest of the items after Durability Test 1 under a high temperature/high humidity out of the entire 10 items.

Toner 3 shows satisfactory H/L and is evaluated as B in two items of fogging after Durability Test 1 under a low temperature/low humidity and fogging after Durability Test 1 under a high temperature/high humidity but A on all the other items.

Toner 4 shows satisfactory H/L and is evaluated as B in two items of an image concentration after Durability Test 1n under a low temperature/low humidity and fogging after Durability Test 1 under a high temperature/high humidity but A in all the other items.

Toner 5 shows satisfactory H/L and is evaluated as B in a storage item but A in all the other items.

Toner 6 shows satisfactory H/L and is evaluated as B in five items of heat resistant storage, an image concentration after Durability Test 1 under a low temperature/low humidity, fogging after Durability Test 1 under a high temperature/high humidity, and filming resistance but A in all the other items.

Toner 7 shows satisfactory H/L and is evaluated as B in heat resistance storage and halftone fading but A in all the other items.

When B or a higher judgment guarantees a practical use of a toner, Toners 2 to 7 may have excellent degradation resistance and other properties and provide a print with high quality even under a severe environment from a low temperature/low humidity to a high temperature/high humidity as well as room temperature/normal humidity.

The reason may be caused by properties of External Additives 1 to 7 respectively added to Toners 2 to 7.

Comparative Examples 1 to 4.

Each toner according to Comparative Examples 1 to 4 is prepared according to the same method as Example 1 except for respectively using Comparative External Additives 1 to 4.

The external additives and toners are evaluated in the same evaluation method as Example 1.

In other words, difference in evaluation results between Examples and Comparative Examples is caused by a difference of the external additives used therein.

<Preparation of Comparative External Additive 1>

Comparative External Additive 1 is obtained according to the same method as the method of producing External Additive 4 except for changing the second process of preparing a particulate dispersion as follows.

In the second process, the amount of distilled water is changed from 50 parts to 150 parts.

In the second process, the amount of a 40% methylamine aqueous solution is changed from 4 parts to 12 parts.

The third process is omitted.

As a result, the solid content is reduced from 3.98% to 2.70%. In addition, the number of adding a silicon compound and a basic compound m+n becomes 2.

A type and an amount of a raw material for Comparative External Additive 1 and a preparation condition of Comparative External Additive 1 are shown in Table 1.

<Properties of Comparative External Additive 1>

Properties of the obtained Comparative External Additive 1 are shown in Table 2.

As shown in Table 2, Comparative External Additive 1 has a number average particle diameter (Dn50) of 132 nm, a first specific surface area (α) of 31 $m^2/g$, true density of 2.13 $g/cm^3$, total light transmittance of 72%, a haze of 12.3%, a coarse particulate ratio of 3.2%, α/β of 1.5, and a hydrophobization degree of 50%. Accordingly, Comparative External Additive 1 does not satisfy Properties (3) to (6).

The reason that Comparative External Additive 1 does not satisfy Properties (3) to (6) is that the number of adding a silicon compound or a basic compound m+n becomes 2, as the third process of adding and mixing the silicon compound or the basic compound is omitted unlike the condition of producing an external additive for a toner.

<Preparation of Comparative External Additive 2>

Comparative External Additive 2 is obtained according to the same method as the method of producing External Additive 4 except for changing the preparation process of a particulate dispersion liquid as follows.

The amount of a component A1, tetraethoxysilane (TEOS), is changed from 60 parts to 80 parts.

The amount of a component B1, a 40% methylamine aqueous solution, is changed from 4 parts to 16 parts.

(C) The amount of water used in the second process is changed from 50 parts to 200 parts.

(D) The third process is changed into one step of adding and mixing 40 parts of a component A2, 8 parts of a component B2, and 100 parts of water.

In addition, a time gap of 10 minutes is set between the addition of Component A2 and the addition of Component B2.

This change makes $W_s/W_o$ to be changed from 0.15 to 0.2.

A type and an amount of a raw material for Comparative External Additive 2 and a preparation condition of Comparative External Additive 2 are shown in Table 1.

<Property Evaluation of Comparative External Additive 2>

Properties of the obtained Comparative External Additive 2 are shown in Table 2.

As shown in Table 2, Comparative External Additive 2 has a number average particle diameter (Dn50) of 230 nm, a first specific surface area (α) of 18 $m^2/g$, true density of 2.00 $g/cm^3$, total light transmittance of 76%, a haze of 14.8%, a coarse particulate ratio of 4.5%, α/β of 1.4, and a hydrophobization degree of 43%. Accordingly, Comparative External Additive 2 does not satisfy Properties (1), (4), (5), and (6).

The reason that Comparative External Additive 2 does not satisfy Properties (1), (4), (5), and (6) is that $W_s/W_o$ is changed into 0.2 unlike a condition of producing the external additives according to Examples.

<Preparation of Comparative External Additive 3>

Comparative External Additive 3 is obtained according to the same method as the method of producing External Additive 1 except for changing the following items in the particulate hydrophobizing process.

The fifth process of combining polar groups on the surface of particulates is omitted. As a result, (T1×t1)+(T2×t2) is changed from 970° C.·hr to 270° C.·hr.

A type and an amount of a raw material for Comparative External Additive 3 and a preparation condition of Comparative External Additive 3 are shown in Table 1.

<Property Evaluation of Comparative External Additive 3>

Properties of the obtained Comparative External Additive 3 are shown in Table 2.

As shown in Table 2, Comparative External Additive 3 has a number average particle diameter (Dn50) of 121 nm, a first specific surface area (α) of 26 $m^2/g$, true density of 2.01 $g/cm^3$, total light transmittance of 80%, a haze of 11.5%, a coarse particulate ratio of 3.6%, α/β of 1.6, and a hydrophobization degree of 28%. Accordingly, Comparative External Additive 3 does not satisfy Properties (4), (5), and (7).

The reason that Comparative External Additive 3 does not satisfy Properties (4), (5), and (7) is that (T1×t1)+(T2×t2) is 270° C.·hr which is less than 480° C.·hr as a result of omitting the fifth process unlike the above condition of producing the external additives according to Examples.

<Preparation of Comparative External Additive 4>

Comparative External Additive 4 is obtained according to the same method as the method of producing External Additive 1 except for changing the particulate hydrophobizing process as follows.

The heat treatment temperature T1 in the fourth is changed from 90° C. to 100° C.

Heat treatment time t1 in the fourth process is changed from 3 hours to 12 hours.

The heat treatment temperature T2 in the fifth process is changed from 100° C. to 150° C.

Heat treatment time t2 in the fifth is changed from 7 hours to 15 hours.

As a result, (T1×t1)+(T2×t2) is changed from 970° C.·hr to 3450° C.·hr.

(E) The solvent in the fifth process is changed from water to diisobutylketone.

<Property Evaluation of Comparative External Additive 4>

Properties of Comparative External Additive 4 are shown in Table 2.

As shown in Table 2, Comparative External Additive 4 has a number average particle diameter (Dn50) of 114 nm, a first specific surface area (α) of 41 $m^2/g$, true density of 2.11 $g/cm^3$, total light transmittance of 78%, a haze of 20.3%, a coarse particulate ratio of 3.2%, α/β of 1.6, and a hydrophobization degree of 75%. Accordingly, Comparative External Additive 4 does not satisfy the properties (2) to (5).

The reason that Comparative External Additive 4 does not satisfy the properties (2) to (5) is that (T1×t1)+(T2×t2) becomes 3450° C.·hr which is greater than 2600° C.·hr since the heat treatment time t1 of the fourth process is 12 hours which is greater than 8 hours, while the heat treatment time t2 of the fourth process is 15 hours which is greater than 12 hours unlike the above condition of producing the external additives according to Examples.

<Preparation of Comparative Toners 1 to 4>

Comparative Toners 1 to 4 are obtained according to the same method as the method of producing Toner 1 except for respectively using Comparative External Additives 1 to 4.

<Evaluation of Comparative Toners 1 to 4>

The same evaluation as used for Toner 1 is performed about Comparative Toners 1 to 4, and the results are shown in Table 3.

As shown in Table 3, the evaluation results of Comparative Toners 1 to 4 are as follows.

Comparative Toner 1 is evaluated as A in only 1 item, B in 3 items, and C in 4 items out of the entire items 10, and its H/L also is inappropriate. Referring to D in the evaluation, Comparative Toner 1 may not be usable.

Comparative Toner 2 is evaluated as D in two items and thus, may not be usable, referring to D in the evaluation.

Comparative Toner 3 is evaluated as D in 1 item and thus may not be usable, referring to D in the evaluation.

Comparative Toner 4 is evaluated as B in 4 items and C in 5 items out of the entire items 10, and its H/L also is inappropriate. However, Comparative Toner 4 is evaluated as C in 50% out of the entire items and thus not usable.

Based on the evaluation results, Comparative Toners 1 to 4 all are not usable and show deteriorated characteristics compared with Toners 1 to 7.

Accordingly, Toners 1 to 7 satisfy Properties (1) to (7) due to External Additives 1 to 7, while as for Comparative Toners 1 to 4, Comparative External Additives 1 to 4 do not satisfy the above properties.

TABLE 1

| Processes | | Items | | External additives | | | | | | |
|---|---|---|---|---|---|---|---|---|---|---|
| | | | | External Additive 1 | External Additie 2 | External Additive 3 | External Additive 4 | External Additive 5 | External Additive 6 | External Additive 7 |
| Preparation process of particulate Dispersion lilil liquid | First process | Solvent | ethanol (parts) | 400 | 400 | 400 | 400 | 400 | 400 | 400 |
| | | Component A1 | TEOS (parts) | 40 | 60 | 20 | 60 | 20 | 20 | 20 |
| | Second process | Component B1 | 40% methylamine aqueous solution (parts) | 8 | 24 | 4 | 4 | 12 | 4 | 4 |
| | | | water (parts) | 100 | 300 | 50 | 50 | 150 | 50 | 50 |
| | Third process | Component A2 | TEOS (parts) | 40 | 60 | 20 | — | 20 | 20 | 20 |
| | | Component B2 | 40% methylamine aqueous solution (parts) | 8 | — | 4 | 4 | — | 4 | 4 |
| | | | water (parts) | 100 | — | 50 | 50 | — | 50 | 50 |
| | | Component A3 | TEOS (parts) | 40 | — | 20 | — | 20 | 20 | 20 |

TABLE 1-continued

| | | | | | | | | | | |
|---|---|---|---|---|---|---|---|---|---|---|
| | | Component B3 | 40% methylamine aqueous solution (parts) | 8 | — | 4 | 4 | — | 4 | 4 |
| | | | Water (parts) | 10 | — | 50 | 50 | — | 50 | 50 |
| | | Component A4 | TEOS (parts) | — | — | 20 | 60 | 20 | 20 | 20 |
| | | Component B4 | 40% methylamine aqueous solution (parts) | — | — | 4 | 4 | 12 | 4 | 4 |
| | | | water (parts) | — | — | 50 | 50 | 150 | 50 | 50 |
| | | Component A5 | TEOS (parts) | — | — | 20 | — | 20 | 20 | 20 |
| | | Component B5 | 40% methylamine aqueous solution (parts) | — | — | 4 | 4 | — | 4 | 4 |
| | | | water (parts) | — | — | 50 | 50 | — | 50 | 50 |
| | | Component A6 | TEOS (parts) | — | — | 20 | — | 20 | 20 | 20 |
| | | Component B6 | 40% methylamine aqueous solution (parts) | — | — | 4 | 4 | — | 4 | 4 |
| | | | water (parts) | — | — | 50 | 50 | — | 50 | 50 |
| | | | Total (parts) | 844 | 844 | 844 | 844 | 844 | 844 | 844 |
| | | | solid (%) | 3.98 | 3.98 | 3.98 | 3.98 | 3.98 | 3.98 | 3.98 |
| | | | The number of Addition (m + n) | 6 | 3 | 12 | 8 | 8 | 12 | 12 |
| | | | weight ratio (Ws/Wo) | 0.10 | 0.15 | 0.05 | 0.15 | 0.05 | 0.05 | 0.05 |
| Particulate hydrophobizing process | Fourth process | Heat treatment | T1 (° C.) | 90 | 90 | 90 | 90 | 90 | 60 | 100 |
| | | | t1 (hr) | 3 | 3 | 3 | 3 | 3 | 8 | 8 |
| | | | T1 × t1 (° C. · hr) | 270 | 270 | 270 | 270 | 270 | 480 | 800 |
| | Fifth process | Heat treatment | T2 (° C.) | 100 | 100 | 100 | 118 | 118 | 0 | 150 |
| | | | t2 (hr) | 7 | 7 | 7 | 7 | 7 | 0 | 12 |
| | | | T2 × t2 (° C. · hr) | 700 | 700 | 700 | 826 | 826 | 0 | 1800 |
| | | | T1 × t1 + T2 × t2 (° C. · hr) | 970 | 970 | 970 | 1096 | 1096 | 480 | 2600 |
| | | Solvent | Water (parts) | 170 | 170 | 170 | — | — | 170 | — |
| | | | methylisobutylketone (parts) | — | — | — | 170 | 170 | — | — |
| | | | diisobutylketone (parts) | — | — | — | — | — | — | 170 |
| | Sixth process | Surface treatment agent | Hexamethyldisilazane | 30 | 30 | 30 | 30 | 30 | 30 | 30 |

| Processes | | | Items | | External additives | | | |
|---|---|---|---|---|---|---|---|---|
| | | | | | Comparative External Additive 1 | Comparative External Additive 2 | Comparative External Additive 3 | Comparative External Additive 4 |
| Preparation process of particulate Dispersion lilil liquid | First process | Solvent | ethanol (parts) | | 400 | 400 | 400 | 400 |
| | | Component A1 | TEOS (parts) | | 60 | 80 | 40 | 40 |
| | Second process | Component B1 | 40% methylamine aqueous solution (parts) | | 12 | 16 | 8 | 8 |
| | | | water (parts) | | 150 | 200 | 100 | 100 |
| | Third process | Component A2 | TEOS (parts) | | — | 40 | 40 | 40 |
| | | Component B2 | 40% methylamine aqueous solution (parts) | | — | 8 | 8 | 8 |
| | | | water (parts) | | — | 100 | 100 | 100 |
| | | Component A3 | TEOS (parts) | | — | — | 40 | 40 |
| | | Component B3 | 40% methylamine aqueous solution (parts) | | — | — | 8 | 8 |
| | | | Water (parts) | | — | — | 100 | 100 |
| | | Component A4 | TEOS (parts) | | — | — | — | — |
| | | Component B4 | 40% methylamine aqueous soluti (parts) | | — | — | — | — |
| | | | water (parts) | | — | — | — | — |

TABLE 1-continued

| | | | | | | | |
|---|---|---|---|---|---|---|---|
| | | Component A5 | TEOS (parts) | — | — | — | — |
| | | Component B5 | 40% methylamine aqueous solution (parts) | — | — | — | — |
| | | | water (parts) | — | — | — | — |
| | | Component A6 | TEOS (parts) | — | — | — | — |
| | | Component B6 | 40% methylamine aqueous solution (parts) | — | — | — | — |
| | | | water (parts) | — | — | — | — |
| | | | Total (parts) | 622 | 844 | 844 | 844 |
| | | | solid (%) | 2.70 | 3.98 | 3.98 | 3.98 |
| | | | The number of Addition (m + n) | 2 | 4 | 6 | 6 |
| | | | weight ratio (Ws/Wo) | 0.15 | 0.20 | 0.10 | 0.10 |
| Particulate hydrophobizing process | Fourth process | Heat treatment | T1 (° C.) | 90 | 90 | 90 | 100 |
| | | | t1 (hr) | 3 | 3 | 3 | 12 |
| | | | T1 × t1 (° C. · hr) | 270 | 270 | 270 | 1200 |
| | Fifth process | Heat treatment | T2 (° C.) | 118 | 118 | 0 | 150 |
| | | | t2 (hr) | 7 | 7 | 0 | 15 |
| | | | T2 × t2 (° C. · hr) | 826 | 826 | 0 | 2250 |
| | | | T1 × t1 + T2 × t2 (° C. · hr) | 1096 | 1096 | 270 | 3450 |
| | | Solvent | Water (parts) | — | — | 170 | — |
| | | | methylisobutylketone (parts) | 170 | 170 | — | — |
| | | | diisobutylketone (parts) | — | — | — | 170 |
| | Sixth process | Surface treatment agent | hexamethyldisilazane | 30 | 30 | 30 | 30 |

TABLE 2

| | External additive | | | | | | |
|---|---|---|---|---|---|---|---|
| | External Additive 1 | External Additive 2 | External Additive 3 | External Additive 4 | External Additive 5 | External Additive 6 | External Additive 7 |
| Number average particle diameterDn50 (nm | 123 | 198 | 93 | 80 | 61 | 98 | 95 |
| First specific surface areaα ($m^2/g$) | 23 | 15 | 21 | 18 | 38 | 26 | 16 |
| True density ($g/cm^3$) | 2.01 | 2.03 | 1.98 | 1.94 | 2.00 | 1.94 | 1.94 |
| Transmittance (%) | 84 | 80 | 85 | 83 | 86 | 88 | 83 |
| Haze (%) | 5.3 | 9.4 | 2.9 | 8.8 | 4.1 | 2.6 | 5.8 |
| Coarse particulate ratio (%) | 1.0 | 2.8 | 0.2 | 0.6 | 0.1 | 0.2 | 1.1 |
| α/β | 0.9 | 1.0 | 0.6 | 0.5 | 0.8 | 0.8 | 0.5 |
| Hydrophobization degree (volume %) | 65 | 63 | 67 | 58 | 62 | 38 | 72 |

| | External additive | | | |
|---|---|---|---|---|
| | Comparative External Additive 1 | Comparative External Additive 2 | Comparative External Additive 3 | Comparative External Additive 4 |
| Number average particle diameterDn50 (nm | 132 | 230 | 121 | 114 |
| First specific surfa areaα ($m^2/g$) | 31 | 18 | 16 | 41 |
| True density ($g/cm^3$) | 2.13 | 2.00 | 2.01 | 2.11 |
| Transmittance (%) | 72 | 76 | 80 | 78 |
| Haze (%) | 12.3 | 14.8 | 11.5 | 20.3 |
| Coarse particulate ratio (%) | 3.2 | 4.5 | 3.6 | 3.2 |
| α/β | 1.5 | 1.4 | 0.6 | 1.6 |
| Hydrophobization degree (volume %) | 50 | 43 | 28 | 75 |

TABLE 3

| Evaluation items | | Example 1 Toner 1 | Example 2 Toner 2 | Example 3 Toner 3 | Example 4 Toner 4 | Example 5 Toner 5 | Example 6 Toner 6 | Example 7 Toner 7 | Comparative Example Comparative Toner 1 | Comparative Example Comparative Toner 2 | Comparative Example Comparative Toner 3 | Comparative Example Comparative Toner 4 |
|---|---|---|---|---|---|---|---|---|---|---|---|---|
| H/L ratio | | 0.49 | 0.52 | 0.47 | 0.43 | 0.49 | 0.41 | 0.52 | 0.26 | 0.31 | 0.35 | 0.43 |
| Heat resistance | | A | A | A | A | B | B | B | C | D | D | B |
| Storage properties | | | | | | | | | | | | |
| After Durability Test 1 under low temperature/ low humidity | Image concentration | A | A | A | B | A | B | A | C | B | B | C |
| | Blackening | B | A | B | A | A | A | A | D | B | B | C |
| After Durability Test 1 under room temperature/ normal humidity | Image concentration | A | A | A | A | A | A | A | B | B | B | C |
| | Blackening | A | A | A | A | A | A | A | B | B | B | C |
| After Durability Test 1 under high temperature/ high humidity | Image concentration | A | B | A | A | A | A | A | A | C | C | B |
| | Blackening | A | A | B | B | A | B | A | B | D | B | B |
| Halftone fading | | B | A | A | A | A | B | B | C | C | C | B |
| Filming resistance | | A | A | A | A | A | B | A | C | C | C | C |

The external additives for a toner according to Examples 8 to 12 which are prepared according to the above method (2) for producing an external additive and toners respectively including these additives are as follows.

Example 8

<Preparation of External Additive 8>

First, an external additive for a toner (External Additive 8) according to Example 8 is prepared.

<1. Particulate Forming Process>

65 parts of isopropanol, 65 parts of acetonitrile, and 64 parts of tetra propixie silane are put in a reaction vessel under a nitrogen atmosphere, and then, a silicon-containing component including these three components is controlled at a temperature TA of 20° C. while stirred at 150 rpm.

On the other hand, a catalyst-containing component including a mixture of 115 parts of distilled water and 5 parts of a 10 wt % ammonia solution and set at a temperature TB of 20° C. is separately prepared.

Subsequently, the entire amount of the catalyst-containing component is at one time added to the silicon-containing component, while maintained at a temperature TB of 20° C. to prepare a mixed solution.

Then, a first reaction process is performed at 20° C. (a first reaction temperature T3) for 5 hours (first reaction time t3), while the mixed solution is controlled to have a liquid temperature of 20° C. and stirred at 150 rpm.

Then, the resultant is heated up to 50° C., and a second reaction is performed at 50° C. (a second reaction temperature T4) for 48 hours (second reaction time t4) to obtain a silica particulate dispersion liquid.

<2. Particulate Recovery Process>

Then, 100 parts of distilled water is added to the silica particulate dispersion liquid, the mixture is heat-concentrated by using an evaporator, until an amount of the silica particulate dispersion liquid is reduced down to a half, and then, solid-liquid separated through a centrifugal settler.

Then, a process of removing a supernatant through decantation, adding 300 parts of distilled water to the sediment, solid-liquid separating the mixture by a centrifugal settler, and removing a supernatant through decantation is twice repeated, and the sediment is lyophilized for 24 hours to obtain white powder.

<3. Particulate Hydrophobizing Process>

10 parts of the white powder is added to a mixture of 100 parts of water and 15 parts of hexamethyldisilazane (HMDS), and the obtained mixture is stirred under a pressure of 850 mmHg in a reaction vessel at 23° C. (a third reaction temperature T5) at 200 rpm for 2 hours (third reaction time t5).

Subsequently, the resultant is stirred at 70° C. (a fourth reaction temperature T6) at 200 rpm for 4 hours (sixth reaction time t6) for a solid-liquid separation.

Then, the obtained sediment is cleaned with methanol and dried at 80° C. for 48 hours to obtain a silica particulate white powder hydrophobized on the surface (External Additive 8).

A type and an amount of a raw material for External Additive 8 and a preparation condition of External Additive 8 are shown in Table 4.

<Property Evaluation of External Additive 8>

The obtained External Additive 8 has a number average particle diameter (Dn50) of 120 nm, true specific gravity of 1.95, 4.5 wt % of particulates in a first specific weight region, 2.6 wt % of particulates in a second specific weight region, a first specific surface area ($\alpha$) of 23.1 $m^2/g$, $\alpha/\beta$ of 0.9, and 7.0 wt % of a loss on heating and satisfies Properties (1), (3), (6), (8), and (9) of the particulate.

Property evaluation results of External Additive 8 are shown in Table 5.

<Preparation of Toner 8>

150 parts of the toner mother particles is mixed with 1.0 part of hydrophobic silica having a small particle diameter of 20 nm and hydrophobized in hexamethyldisilazane (HMDS) (TS720: Carbot Corp.) and 0.4 parts of External Additive 8, and the mixture is mixed at 10,000 rpm for 30 seconds in a sample mill to obtain Toner 8.

<Evaluation of Toner 8>

The above evaluation about characteristics of Toner 8 is performed, and the results are shown in Table 6.

As shown in Table 6, Toner 8 is evaluated as A in all the entire 20 items.

Considering that A evaluation secures an appropriate use of a toner, Toner 8 has excellent degradation resistance and other properties and provides a print with high quality under a severe environment from a low temperature/low humidity to a high temperature/high humidity as well as room temperature/normal humidity.

The reason is caused by properties of External Additive 8 added to Toner 8.

Example 9

<Preparation of External Additive 9>

External Additive 9 is obtained according to the same process as the process of producing External Additive 8 except for changing the external additive producing process as follows.

In the particulate forming process, the ammonia solution, which is 10 wt % of the catalyst-containing component, is used in an amount of 30 parts instead of 5 parts.

In the particulate forming process, the temperature TA of the silicon-containing component is changed from 20° C. to 10° C.

In the particulate forming process, the temperature TB of the catalyst-containing component is changed from 20° C. to 10° C.

In the particulate forming process, the first reaction temperature T3 is changed from 20° C. to 10° C.

In the particulate forming process, the second reaction temperature T4 is changed from 50° C. to 30° C.

In the particulate forming process, the second reaction time T4 is changed from 48 hours to 80 hours.

In the particulate hydrophobizing process, the amount of HMDS is changed from 15 parts to 6 parts.

A type and an amount of a raw material for External Additive 9 and a preparation condition of External Additive 9 are shown in Table 4.

<Property Evaluation of External Additive 9>

External Additive 9 has a number average particle diameter (Dn50) of 240 nm, true specific gravity of 1.92, 1.3 wt % of particulates in a first specific weight region, 1.1 wt % of particulates in second specific weight region, a first specific surface area ($\alpha$) of 9.1 $m^2/g$, $\alpha/\beta$ of 0.7, and 9.0 wt % of a loss on heating and satisfies Properties (1), (3), (6), (8), and (9) of the particulate.

Property evaluation results of External Additive 9 are shown in Table 5.

Example 10

<Preparation of External Additive 10>

External Additive 10 is obtained according to the same process as the process of producing External Additive 8 except for changing the external additive producing process as follows.

In the particulate forming process, the ammonia solution, which is 10 wt % of the catalyst-containing component, is used in an amount of 1 part instead of 5 parts.

In the particulate forming process, the temperature TA of the silicon-containing component is changed from 20° C. to 30° C.

In the particulate forming process, the temperature TB of the catalyst-containing component is changed from 20° C. to 30° C.

In the particulate forming process, the first reaction temperature T3 is changed from 20° C. to 30° C.

In the particulate forming process, the second reaction temperature T4 is changed from 50° C. to 70° C.

In the particulate forming process, the second reaction time 14 is changed from 48 hours to 34 hours.

In the particulate hydrophobizing process, the amount of HMDS is changed from 15 parts to 33 parts.

A type and an amount of a raw material for External Additive 10 and a preparation condition of External Additive 10 are shown in Table 4.

<Property Evaluation of External Additive 10>

External Additive 10 has a number average particle diameter (Dn50) of 60 nm, true specific gravity of 1.98, 7.2 wt % of particulates in a first specific weight region, 4.2 wt % of particulates in a second specific weight region, a first specific surface area ($\alpha$) of 50.5 $m^2/g$, $\alpha/\beta$ 1.0, and 3.0 wt % of a loss on heating and satisfies Properties (1), (3), (6), (8), and (9) of the particulate.

Property evaluation results of External Additive 10 are shown in Table 5.

Example 11

<Preparation of External Additive 11>

External Additive 11 is obtained according to the same process as the method of producing External Additive 8 except for changing the external additive producing process as follows.

In the particulate forming process, the ammonia solution, which is 10 wt % of the catalyst-containing component, is used in an amount of 17 parts instead of 5 parts.

In the particulate forming process, the second reaction temperature T4 is changed from 50° C. into 35° C.

In the particulate forming process, the second reaction time T4 is changed from 48 hours to 69 hours.

In the particulate hydrophobizing process, the amount of HMDS is changed from 15 parts to 9 parts.

A type and an amount of a raw material for External Additive 11 and a preparation condition of External Additive 11 are shown in Table 4.

<Property Evaluation of External Additive 11>

External Additive 11 has a number average particle diameter (Dn50) of 180 nm, true specific gravity of 1.93, 6.3 wt % of particulates in a first specific weight region, 3.1 wt % of particulates in a second specific weight region, a first specific surface area ($\alpha$) of 13.8 $m^2/g$, $\alpha/\beta$ of 0.8, and 8.5 wt % of a loss on heating and satisfies Properties (1), (3), (6), (8), and (9) of the particulate.

Property evaluation results of External Additive 11 are shown in Table 5.

Example 12

<Preparation of External Additive 12>

External Additive 12 is obtained according to the same process as the process of producing External Additive 8 except for changing the external additive producing process as follows.

In the particulate forming process, the ammonia solution, which is 10 wt % of the catalyst-containing component, is used in an amount of 2 parts instead of 5 parts.

In the particulate forming process, the second reaction temperature T4 is changed from 50° C. to 60° C.

In the particulate forming process, the second reaction time T4 is changed from 48 hours to 40 hours.

In the particulate hydrophobizing process, the amount of HMDS is changed from 15 parts to 20 parts.

A type and an amount of a raw material for External Additive 12 and a preparation condition of External Additive 12 are shown in Table 4.

<Property Evaluation of External Additive 12>

The obtained External Additive 12 has a number average particle diameter (Dn50) of 90 nm, true specific gravity of 1.96, 8.5 wt % of particulates in a first specific weight region, 4.9 wt % of particulates in a second specific weight region, a first specific surface area (α) of 30.6 $m^2/g$, α/β of 0.9, and 6.0 wt % of a loss on heating and thus may satisfy Properties (1), (3), (6), (8), and (9) of the particulate.

Property evaluation results of External Additive 12 are shown in Table 6.

<Preparation of Toners 9 to 12>

Toners 9 to 12 are obtained according to the same process as the process of producing Toner 8 except for respectively using External Additives 9 to 12 instead of External Additive 8.

<Evaluation of Toners 9 to 12>

The same evaluation as performed in Toner 8 is performed about the toners 9 to 12, and the results are shown in Table 6.

As shown in Table 6, the evaluation about Toners 9 to 12 is as follows.

Toner 9 is evaluated as B in filming resistance after Durability Test 3 under a high temperature/high humidity, C in member contamination after a Durability Test 2 under a low temperature/low humidity, but A in all the other items out of the entire 20 items. Toner 9 may be appropriately used with a B and C reference even though there is C on 1 item.

Toner 10 is evaluated as C in fine line reproducibility after a Durability Test 2 under a high temperature/high humidity but A in all the other items out of the entire 20 items. Toner 10 is evaluated as C in 1 item but may be appropriately used based on a C reference.

Toner 11 is evaluated as B in filming resistance after Durability Test 3 under a high temperature/high humidity and in member contamination after a Durability Test 2 under a low temperature/low humidity but A in all the other items out of the entire 20 items. Toner 11 is evaluated as B in the 2 items but may be appropriately used based on the B reference.

Toner 12 is evaluated as B in fine line reproducibilitys after a Durability Test 2 under a high temperature/high humidity but A in all the other items out of the entire 20 items. Toner 12 may be appropriately used based on the B reference.

Comparative Examples 5 to 7

<Preparation of Comparative External Additive 5>

Comparative External Additive 5 is obtained according to the same process as the process of producing External Additive 8 except for changing the external additive producing process as follows.

In the particulate forming process, the silicon-containing component is changed from 64 parts of tetrapropixie silane to 37 parts of tetramethoxysilane.

In the particulate hydrophobizing process, the amount of HMDS is changed from 15 parts to 11 parts.

A type and an amount of a raw material for Comparative External Additive 5 and a preparation condition of Comparative External Additive 5 are shown in Table 4.

<Property Evaluation of Comparative External Additive 5>

Properties of Comparative External Additive 5 are shown in Table 5.

As shown in Table 5, Comparative External Additive 5 has a number average particle diameter (Dn50) of 120 nm, true specific gravity of 2.05, 10.5 wt % of particulates in a first specific weight region, 0.2 wt % of particulates in a second specific weight region, a first specific surface area (α) of 17.1 $m^2/g$, α/β of 0.7, and 0.1 wt % of a loss on heating and satisfies Properties (6), (8), and (9).

<Preparation of Comparative External Additive 6>

Comparative External Additive 6 is obtained according to the same process as the process of producing External Additive 8 except for changing the external additive producing process as follows.

In the particulate forming process, the ammonia solution, which is 10 wt % of the catalyst-containing component, is used in an amount of 0.5 parts instead of 5 parts.

In the particulate forming process, the temperature TA of the silicon-containing component is changed from 20° C. to 40° C.

In the particulate forming process, the temperature TB of the catalyst-containing component is changed from 20° C. to 40° C.

In the particulate forming process, the first reaction temperature T3 is changed from 20° C. to 40° C.

In the particulate forming process, the second reaction temperature T4 is changed from 50° C. to 60° C.

In the particulate forming process, the second reaction time T4 is changed from 48 hours to 40 hours.

In the particulate hydrophobizing process, the amount of HMDS Is changed from 15 parts to 74 parts.

A type and an amount of a raw material for Comparative External Additive 6 and a preparation condition of Comparative External Additive 6 are shown in Table 4.

<Property Evaluation of Comparative External Additive 6>

Properties of Comparative External Additive 6 are shown in Table 5.

As shown in Table 5, Comparative External Additive 6 has a number average particle diameter (Dn50) of 30 nm, true specific gravity of 2.10, 0.1 wt % of particulates in a first specific weight region, 0.1 wt % of particulates in a second specific weight region, a first specific surface area (α) of 114.3 $m^2/g$, α/β of 1.2, and 0 wt % of a loss on heating and satisfies Properties (1), (6), (8), and (9).

<Preparation of Comparative External Additive 7>

Comparative External Additive 7 is obtained according to the same process as the process of producing External Additive 8 except for changing the external additive producing process as follows.

In the particulate forming process, the ammonia solution, which is 10 wt % of the catalyst-containing component, is used in an amount of 35 parts instead of 5 parts.

In the particulate forming process, the temperature TA of the silicon-containing component is changed from 20° C. to 5° C.

In the particulate forming process, the temperature TB of the catalyst-containing component is changed from 20° C. to 5° C.

In the particulate forming process, the first reaction temperature T3 is changed from 20° C. to 5° C.

In the particulate forming process, the second reaction temperature T4 is changed from 50° C. to 20° C.

In the particulate forming process, the second reaction time T4 is changed from 48 hours to 120 hours.

In the particulate forming process, the amount of HMDS is changed from 15 parts to 5 parts.

A type and an amount of a raw material for Comparative External Additive 7 and a preparation condition of Comparative External Additive 7 are shown in Table 4.

<Property Evaluation of Comparative External Additive 7>

Properties of Comparative External Additive 7 are shown in Table 5.

As shown in Table, Comparative External Additive 7 has a number average particle diameter (Dn50) of 270 nm, true specific gravity of 1.92, 0.3 wt % of particulates in a first specific weight region, 0.2 wt % of particulates in a second specific weight region, a first specific surface area (α) of 6.9 $m^2/g$, α/β of 0.6, and 10.3 wt % of a loss on heating and satisfies Properties (1), (6), (8), and (9).

<Preparation of Comparative Toners 5 to 7>

Comparative Toners 5 to 7 are obtained according to the same process as the process of producing Toner 8 except for respectively using Comparative External Additives 5 to 7 instead of the external additive.

<Evaluation of Comparative Toners 5 to 7>

The same evaluation as performed in Toner 8 is performed about Comparative Toners 5 to 7, and the results are shown in Table 6.

Comparative Toner 5 is evaluated as A in 16 items out of the entire 20 items but as C in 4 items after a Durability Test 2 under a low temperature/low humidity environment. Based on a C reference that a toner having greater than or equal to 2 C's, Comparative Toner 5 is not usable. The reason is that Comparative External Additive 5 added to Comparative Toner 5 does not satisfy Property (8), and in addition, the fact that Comparative External Additive 5 does not satisfy Properties (6) and (9) also has an influence thereon.

Comparative Toner 6 receives D in 3 items such as filming resistance after Durability Test 3 and other tests under a high temperature/high humidity environment. Based on a D reference, Comparative Toner 6 is not useable. The reason is that Comparative External Additive 6 added to Comparative Toner 6 does not satisfy Properties (1) and (8), and a fact that Comparative External Additive 6 does not satisfy Properties (6) and (9) additionally has an influence thereon.

Comparative Toner 7 receives D in the two items of filming resistance after Durability Test 3 under a high temperature/high humidity environment and a member contamination after Durability Test 2 under a low temperature/low humidity environment. Based on the D reference, Comparative Toner 7 is not usable. The reason is that Comparative External Additive 7 added to Comparative Toner 7 does not satisfy Properties (1) and (8), and a fact that Comparative External Additive 7 does not satisfy Properties (6) and (9) additionally has an influence thereon.

As a result, Comparative Toners 5 to 7 all are not useable and have deteriorated characteristics compared with Toners 8 to 12.

The reason is that Toners 8 to 12 according to Examples satisfy Properties (1), (3), (6), (8), and (9) due to External Additives 8 to 12, but Comparative Toners 5 to 7 do not satisfy the properties due to Comparative External Additives 5 to 7.

TABLE 4

| | | | External Additive 8 | External Additive 9 | External Additive 10 | External Additive 11 | External Additive 12 | Comparative Example 5 | Comparative Example 6 | Comparative Example 7 |
|---|---|---|---|---|---|---|---|---|---|---|
| Particulate forming process | Silicon-containing component | isopropanol (parts) | 65 | 65 | 65 | 65 | 65 | 65 | 65 | 65 |
| | | acetonitrile (parts) | 65 | 65 | 65 | 65 | 65 | 65 | 65 | 65 |
| | | tetrapropoxysilane (parts) | 64 | 64 | 64 | 64 | 64 | — | 64 | 64 |
| | | tetramethoxysilane (parts) | — | — | — | — | — | 37 | — | — |
| | catalyst-containing component | distilled water (parts) | 115 | 115 | 115 | 115 | 115 | 115 | 115 | 115 |
| | | 10 wt % ammonia waer (parts) | 5 | 30 | 1 | 17 | 2 | 5 | 0.5 | 35 |
| | Temperature TA (° C.) of silicon-containing component | | 20 | 10 | 30 | 20 | 20 | 20 | 40 | 5 |
| | Temperature TB (° C.) of catalyst-containing component | | 20 | 10 | 30 | 20 | 20 | 20 | 40 | 5 |
| | The number of stirring rotation (rpm) | | 150 | 150 | 150 | 150 | 150 | 150 | 150 | 150 |
| | First reaction temperature T3 (° C.) | | 20 | 10 | 30 | 20 | 20 | 20 | 40 | 5 |
| | First reaction time t3 (hours) | | 5 | 5 | 5 | 5 | 5 | 5 | 5 | 5 |
| | Second reaction temperature T4 (° C.) | | 50 | 30 | 70 | 35 | 60 | 50 | 60 | 20 |
| | Second reaction time t4 (hours) | | 48 | 80 | 34 | 69 | 40 | 48 | 40 | 120 |
| particulate hydrophobization process | White powder (parts) | | 10 | 10 | 10 | 10 | 10 | 10 | 10 | 10 |
| | Water (parts) | | 100 | 100 | 100 | 100 | 100 | 100 | 100 | 100 |
| | HMDS (parts) | | 15 | 6 | 33 | 9 | 20 | 11 | 74 | 5 |
| | Pressure (mmHg) | | 850 | 850 | 850 | 850 | 850 | 850 | 850 | 850 |
| | Third reaction temperatureT5 (° C.) | | 23 | 23 | 23 | 23 | 23 | 23 | 23 | 23 |
| | Third reaction time t5 (hours) | | 2 | 2 | 2 | 2 | 2 | 2 | 2 | 2 |
| | Fourth reaction temperature T6 (° C.) | | 70 | 70 | 70 | 70 | 70 | 70 | 70 | 70 |
| | Fourth reaction time t6 (hours) | | 4 | 4 | 4 | 4 | 4 | 4 | 4 | 4 |
| | The number of stirring rotation (rpm) | | 200 | 200 | 200 | 200 | 200 | 200 | 200 | 200 |

TABLE 5

| | External Additive 8 | External Additive 9 | External Additive 10 | External Additive 11 | External Additive 12 | Comparative External Additive 5 | Comparative External Additive 6 | Comparative External Additive 7 |
|---|---|---|---|---|---|---|---|---|
| Number average particle diameter (nm) | 120 | 240 | 60 | 180 | 90 | 120 | 30 | 270 |
| True specific gravity$d_{1.00}$ | 1.95 | 1.92 | 1.98 | 1.93 | 1.96 | 2.05 | 2.1 | 1.92 |
| First specific weight region (wt %) | 4.5 | 1.3 | 7.2 | 6.3 | 8.5 | 10.5 | 0.1 | 0.3 |
| Second specific weight region (wt %) | 2.6 | 1.1 | 4.2 | 3.1 | 4.9 | 0.2 | 0.1 | 0.2 |
| First specific surface area(α) ($m^2/g$) | 23.1 | 9.1 | 50.5 | 13.8 | 30.6 | 17.1 | 114.3 | 6.9 |
| Second specific surface area(β) ($m^2/g$) | 25.6 | 13.0 | 50.5 | 17.3 | 34.0 | 24.4 | 95.2 | 11.6 |
| α/β | 0.9 | 0.7 | 1.0 | 0.8 | 0.9 | 0.7 | 1.2 | 0.6 |
| Loss on heating (wt %) | 7.0 | 9.0 | 3.0 | 8.5 | 6.0 | 0.1 | 0.0 | 10.3 |

TABLE 6

| | | | Example 8 | Example 9 | Example 10 | Example 11 | Example 12 | Comparative Example 5 | Comparative Example 6 | Comparative Example 7 |
|---|---|---|---|---|---|---|---|---|---|---|
| Room temperature/normal humidity | Initial | Image concentration | A | A | A | A | A | A | A | A |
| | | blackening | A | A | A | A | A | A | A | A |
| | | Fine line reproducibility | A | A | A | A | A | A | A | A |
| | After Durability Test 2 | Image concentration | A | A | A | A | A | A | B | A |
| | | blackening | A | A | A | A | A | A | B | A |
| | | fine line reproducibility | A | A | A | A | A | A | B | A |
| High temperature/ high humidity | Initial | Image concentration | A | A | A | A | A | A | A | A |
| | | Blackening | A | A | A | A | A | A | A | A |
| | | fine line reproducibility | A | A | A | A | A | A | A | A |
| | After Durability Test 2 | Image concentration | A | A | A | A | A | A | D | A |
| | | Blackening | A | A | A | A | A | A | D | A |
| | | Fine line reproducibility | A | A | C | A | B | A | D | A |
| | After Durability Test 3 | Filming resistance | A | B | A | B | A | A | B | D |
| Low temperature/ low humidity | Initial | Image concentration | A | A | A | A | A | A | A | A |
| | | Blackening | A | A | A | A | A | A | A | A |
| | | Fine line reproducibility | A | A | A | A | A | A | A | A |
| | After Durability Test 2 | Image concentration | A | A | A | A | A | C | A | C |
| | | Blackening | A | A | A | A | A | C | A | C |
| | | Fine line reproducibility | A | A | A | A | A | C | A | C |
| | | Member contamination | A | C | A | B | A | C | A | D |

In Examples 1 to 12, Toners 1 to 12 are produced by respectively adding External Additives 1 to 12 to the toner mother particle 1, but other external additives may be added to External Additives 1 to 12.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An external additive for a toner, the external additive comprising:

a particulate of a polymerization product of at least one silicon compound selected from a silane compound represented by Chemical Formula 1: $Si(OR^1)_4$ (wherein $R^1$ is a C1 to C6 monovalent hydrocarbon group) and/or a hydrolysis-condensation product thereof, wherein the particulate has:

a number average particle diameter of about 50 nm to about 250 nm, a first specific surface area (α) measured by a gas adsorption method of about 13 $m^2/g$ to about 80 $m^2/g$, and true density measured by a nominal volume expansion method of about 1.9 $g/cm^3$ to about 2.1 $g/cm^3$, wherein a total light transmittance of a film comprising the particulate, having a thickness of 100 μm, is greater than or equal to about 80%, and has a haze of less than or equal to about 10%.

2. The external additive for a toner of claim 1, wherein the particulate has:

the number average particle diameter of about 60 nm to about 200 nm, and the first specific surface area (α) of about 15 $m^2/g$ to about 40 $m^2/g$.

3. The external additive for a toner of claim 1, wherein a presence ratio of the particulate is less than or equal to average about 3%, wherein the presence ratio is defined as an area of a circumscribed circle relative to the visual area of the particulate under a scanning electron microscope of a ×10000 magnification and visual area of 110 $\mu m^2$, is defined as a presence ratio of a coarse particulate.

4. The external additive for a toner of claim 1, wherein the particulate has a ratio (α/β) of the first specific surface area (α) relative to a second specific surface area (β) calculated from a number average particle diameter of about 0.4 to about 1.75.

5. The external additive for a toner of claim 1, wherein a surface hydrophobization degree of the particulate is about 30 volume % to about 80 volume %.

6. The external additive for a toner of claim 1, wherein, when the particulate is dispersed in a solution, a value obtained by dividing a specific gravity distribution of the particulate dispersed in the solution by the true density measured by a nominal volume expansion method is referred to as a specific weight distribution, and about 95% to about 100% of the specific weight distribution is referred to as a first specific weight region, about 90% to about 95% of the specific weight distribution is referred to as a second specific weight region is referred to as a second specific weight, the external additive for a toner comprises:

the first specific weight region including about 0.5 wt % to about 9 wt % of the particulate, and the second specific weight region including about 0.5 wt % to about 6 wt % of the particulate based on a total amount of the particulate dispersed in the solution.

7. An external additive for a toner, the external additive comprising:

a particulate of a polymerization product of at least one silicon compound selected from a silane compound represented by Chemical Formula 1: $Si(OR^1)_4$ (wherein $R^1$ is a C1 to C6 monovalent hydrocarbon group) and/or a hydrolysis-condensation product thereof, wherein the particulate has:

a number average particle diameter of about 50 nm to about 250 nm, a first specific surface area (α) measured by a gas adsorption method of about 13 $m^2/g$ to about 80 $m^2/g$, and a true density measured by a nominal volume expansion method of about 1.9 $g/cm^3$ to about 2.1 $g/cm^3$, wherein a loss on heating of the particulate is about 3 wt % to about 10 wt %.

8. A process for producing an external additive for a toner, the process comprising performing, at least once, processes of dissolving at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof in an organic solvent to obtain a silicon compound solution, mixing the silicon compound solution and a catalyst-containing component including a basic compound with a solution including water to obtain a mixed solution; and adding at least one of the silicon compound and the catalyst-containing component to the mixed solution and mixing them to obtain particulate dispersion liquid.

9. The method of claim 8, wherein the process for producing the external additive for a toner comprises:

adding the catalyst-containing component after adding the silicon compound when the silicon compound and the catalyst-containing component are added during obtaining of the particulate dispersion liquid.

10. The method of claim 8, wherein in the process for producing an external additive for a toner, when a weight of the organic solvent is referred to as $W_o$ during obtaining of the silicon compound solution and a maximum weight of the silicon compound that added once is referred to as $W_s$ during obtaining of the silicon compound solution and obtaining of the particulate dispersion liquid, $W_s/W_o$ is less than or equal to about 0.15.

11. The method of claim 8, wherein the process for producing an external additive for a toner further comprises removing the catalyst-containing component from the particulate dispersion liquid.

12. The method of claim 11, wherein the removing of the catalyst-containing component is performed at a removal temperature (T1) of about 60° C. to about 100° C. and a removal time (t1) of less than or equal to about 8 hours.

13. The method of claim 12, wherein the process for producing an external additive for a toner comprises hydrophobizing a surface of the particulate obtained from removing of the catalyst-containing component to obtain a first hydrophobized particulate.

14. The method of claim 13, wherein the obtaining of the first hydrophobized particulate is performed at a treatment temperature (T2) of about 80° C. to about 150° C. and a treatment time (t2) of less than or equal to about 12 hours.

15. The process for producing an external additive for a toner of claim 14, wherein the removal temperature (T1), the removal time (t1), the treatment temperature (T2) and the treatment time (t2) satisfy a relationship of $480 \leq (T1 \times t1) + (T2 \times t2) \leq 2600$.

16. The process for producing an external additive for a toner of claim 11, wherein the process further comprises hydrophobizing a surface of the first hydrophobized particulate using at least one compound selected from a silazane compound represented by Chemical Formula 2: $R^2_3SiNHSiR^2_3$ (wherein $R^2$ is a C1 to C6 monovalent hydrocarbon group) and a silane compound represented by Chemical Formula 3: $R^3_3SiX$ (wherein $R^3$ is a C1 to C6 monovalent hydrocarbon group and X is a hydroxy group or a hydrolytic group) as a hydrophobization agent to obtain a second hydrophobized particulate.

17. A toner comprising the external additive for a toner of claim 1.

18. An external additive for a toner, the external additive comprising:

a particulate of a polymerization product of at least one silicon compound selected from a silane compound represented by Chemical Formula 1: $Si(OR^1)_4$ (wherein $R^1$ is a C1 to C6 monovalent hydrocarbon group) and a hydrolysis-condensation product thereof, wherein the particulate has a surface hydrophobization degree of about 30 volume % to about 80 volume %, and a total light transmittance of a film comprising the particulate, having a thickness of 100 μm, is greater than or equal to about 80% and has a haze of less than or equal to about 10%.

19. The external additive of claim 18, wherein the particulate has a ratio (α/β) of a first specific surface area (α) relative to a second specific surface area (β) calculated from a number average particle diameter of about 0.4 to about 1.75, wherein the first specific surface area is a specific surface area of the particulate measured by the gas adsorption method, and the second specific surface area is a specific surface area calculated based on a measured number average particle diameter and a measured true density of the particulate.

* * * * *